US008350142B2

(12) United States Patent
Fujiwara et al.

(10) Patent No.: US 8,350,142 B2
(45) Date of Patent: Jan. 8, 2013

(54) ELECTRONIC SUPPORTING SYSTEM FOR MUSICIANS AND MUSICAL INSTRUMENT EQUIPPED WITH THE SAME

(75) Inventors: Yuji Fujiwara, Hamamatsu (JP); Tsutomu Sasaki, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 345 days.

(21) Appl. No.: 12/767,281

(22) Filed: Apr. 26, 2010

(65) Prior Publication Data

US 2010/0288102 A1 Nov. 18, 2010

(30) Foreign Application Priority Data

May 13, 2009 (JP) ..... 2009-116759

(51) Int. Cl.
*G10H 1/00* (2006.01)

(52) U.S. Cl. ..... 84/615; 84/626; 84/633; 84/653; 84/658

(58) Field of Classification Search ..... 84/615, 84/626, 633, 653, 658, 665, 719
See application file for complete search history.

(56) References Cited

U.S. PATENT DOCUMENTS

| | | | | |
|---|---|---|---|---|
| 2006/0213357 | A1* | 9/2006 | Ohba | 84/723 |
| 2006/0272469 | A1* | 12/2006 | Meisel | 84/21 |
| 2007/0221036 | A1* | 9/2007 | Fujiwara | 84/21 |
| 2008/0017014 | A1* | 1/2008 | Suzuki | 84/385 R |
| 2008/0314230 | A1* | 12/2008 | Sasaki et al. | 84/601 |
| 2010/0288102 | A1* | 11/2010 | Fujiwara et al. | 84/13 |

FOREIGN PATENT DOCUMENTS

| | | |
|---|---|---|
| JP | 2000-259148 | 9/2000 |

* cited by examiner

*Primary Examiner* — David S. Warren
(74) *Attorney, Agent, or Firm* — Harness, Dickey & Pierce, PLC

(57) ABSTRACT

An automatic player piano is equipped with an electronic supporting system, which makes a player learn an optimum pedal stroke to a half pedal region; while the player is practicing a music tune on the piano, the electronic supporting system monitors the damper pedal; when the player starts to depress the damper pedal, the electronic supporting system exerts an assisting force on the damper pedal so as to make the player feel the damper pedal light; when the damper pedal reaches an entrance of the half pedal region, the electronic supporting system removes the assisting force from the damper pedal so that the player feels the damper pedal heavy, whereby the player learns the pedal stroke to the half pedal region through the change of load borne by the player.

20 Claims, 15 Drawing Sheets

| Damper Pedal Stroke yx | Variable uf |
|---|---|
| 0 | 0 |
| yx1 | uf1 |
| yx2 | uf2 |
| yx3 | uf3 |
| ⋮ | ⋮ |
| ⋮ | ⋮ |
| XH | 0 |
| ⋮ | ⋮ |
| ⋮ | ⋮ |
| XE | 0 |

| Damper Pedal Stroke yx | Variable uf |
|---|---|
| 0 | 0 |
| yx1 | 0 |
| yx2 | 0 |
| yx3 | 0 |
| ⋮ | ⋮ |
| yxn | 0 |
| XH1 | UF1 |
| yx11 | uf11 |
| yx12 | uf12 |
| ⋮ | ⋮ |
| XH2 | UF2 |
| yx21 | 0 |
| ⋮ | ⋮ |
| XE | 0 |

ELECTRONIC SUPPORTING SYSTEM FOR MUSICIANS AND MUSICAL INSTRUMENT EQUIPPED WITH THE SAME

FIELD OF THE INVENTION

This invention relates to an electronic supporting system and, more particularly, to an electronic supporting system which makes musicians accurately finger and/or pedal on musical instruments and a musical instrument equipped with the electronic supporting system.

DESCRIPTION OF THE RELATED ART

It is not easy to make good progress in music performance on musical instruments. Especially, musicians become skilled in fingering and pedaling after long time through difficult practice. This is because of the fact that the keys and pedals of musical instrument are different from the bistable switches. For example, a pianist usually moves the keys of a piano between the rest positions and the end positions. When the pianist finds notes to be fingered through high-speed repetition of a key, they repeatedly make the keys return on the way to the end positions and on the way to the rest positions. In the high-speed repetition, the pianist changes the direction of key movements immediately after the let-off of hammer from the jack of action unit. The pianist has to learn the timing to make the hammer let off through the training for a long time. If the pianist changes the direction of key movements before the let-off, the hammer is not brought into collision with the string, and a missing tone takes place in the repetition.

The pianist has to learn accurate pedaling through the training for a long time. For example, a pianist usually fully depresses the damper pedal for prolonging the tone. When the pianist stops the damper pedal on the way to the end position, the player can make the dampers lightly bought into contact with the strings. In this situation, the hammers give rise to the weak vibrations of the strings through the collision with the strings so that the loudness of tones is lessened. The pedal state in which the dampers are lightly held in contact with the strings is called as "half pedal". The pianist has to learn the pedal position for the half pedal through training for a long time.

As described hereinbefore, the fingering and pedaling are not easy to learn. However, the music students and beginners want accurately to control the keys for the let-off timing and the damper pedal for the half pedal in the performance on the piano. In order to assist the music students and beginners in the practice, a supporting system was proposed, and is disclosed in Japan Patent Application laid-open No. 2000-259148.

The prior art supporting system is used in learning the half pedal, and includes a position sensor, a stroke indicator and a controller. The position sensor monitors the damper pedal, and supplies a pedal position signal representative of the current position of damper pedal to the controller. The stroke indicator has a movable hand, and the hand is moved on a scale for the pedal stroke. Boundary plates are overlapped with the scale, and teach the pedal stroke appropriate for the half pedal to the pianist. If the hand is indicative of the pedal stroke outside the half pedal range between the boundary plates, the dampers are spaced from the strings or fully held in contact with the strings.

The controller processes the piece of pedal stroke information, which rides on the pedal position signal, and drives the hand for indicating the current pedal position. The pianist acquires the piece of pedal stroke information by reading the current pedal position from the stroke indicator. If the damper pedal is to shallow, or if the damper pedal is too deep, the hand is indicative of the pedal stroke out of the half pedal range. In this situation, the pianist regulates the stroke of damper pedal to a pedal stroke within the half pedal range. Thus, the prior art supporting system informs the pianist of the current pedal position inside or outside of the half pedal range through the eyesight.

A problem is encountered in the prior art supporting system in that the pianist can not concurrently see the music score and the stroke indicator. If the pianist continuously watches the stroke indicator, he or she is liable to fail correctly to finger on the keys. On the other hand, if the pianist continuously checks the music score for the music passage to be fingered, the prior art supporting system can not give any profit to the pianist.

SUMMARY OF THE INVENTION

It is therefore an important object of the present invention to provide a supporting system, which permits a player to know an appropriate fingering and/or an appropriate pedaling without any interruption of reading a music score.

It is also an important object of the present invention to provide a musical instrument, which is equipped with the supporting system.

To accomplish the object, the present invention proposes to change load borne by a human player at a target position.

In accordance with one aspect of the present invention, there is provided an electronic supporting system for a human player who plays on a musical instrument equipped with at least one manipulator moved by the human player from a rest position to an end position through a track, and the electronic supporting system comprises an actuator provided for the aforesaid at least one manipulator and responsive to a driving signal for exerting an assisting force on the aforesaid at least one manipulator, thereby making load for moving the aforesaid at least one manipulator on the track sharable between the human player and the actuator, a sensor monitoring the aforesaid at least one manipulator and producing a detecting signal representative of an actual physical quantity expressing movements of the aforesaid at least one manipulator on the track and a controller connected to the sensor and the actuator, checking the actual physical quantity to see whether the aforesaid at least one manipulator reaches a target position on the track for producing an answer and varying a magnitude of driving signal depending upon the answer for changing a part of the load borne by the human player at the target position.

In accordance with another aspect of the present invention, there is provided a musical instrument for performing a music tune by a human player comprising at least one manipulator moved by the human player from a rest position to an end position through a track for designating an attribute of tones, a mechanical tone generating system connected to the aforesaid at least one manipulator and producing the tones having the attribute and an electronic supporting system, and the electronic supporting system includes an actuator provided for the aforesaid at least one manipulator and responsive to a driving signal for exerting an assisting force on the aforesaid at least one manipulator, thereby making load for moving the aforesaid at least one manipulator on the track sharable between the human player and the actuator, a sensor monitoring the aforesaid at least one manipulator and producing a detecting signal representative of an actual physical quantity expressing movements of the aforesaid at least one manipulator on the track and a controller connected to the sensor and the actuator, checking the actual physical quantity to see whether the aforesaid at least one manipulator reaches a target position on the track for producing an answer and varying a magnitude of driving signal depending upon the answer for changing a part of the load borne by the human player at the target position.

BRIEF DESCRIPTION OF THE DRAWINGS

The features and advantages of the supporting system and musical instrument will be more clearly understood from the following description taken in conjunction with the accompanying drawings, in which.

DESCRIPTION OF THE PREFERRED EMBODIMENTS

Figure 1:
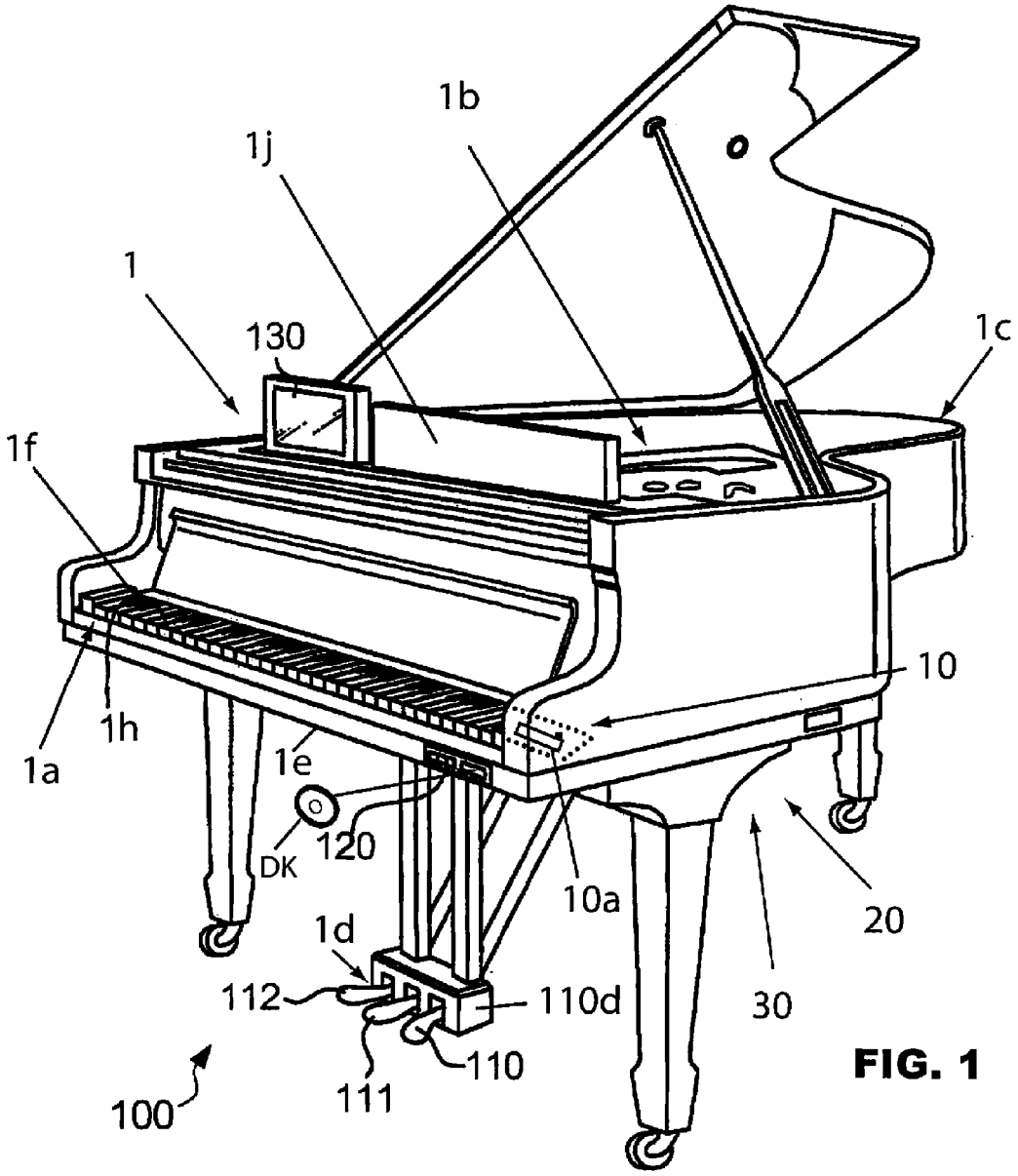
FIG. 1 is a perspective view showing the external appearance of an automatic player piano of the present invention.

A musical instrument embodying the present invention is used in performance on a music tune by a human player, and largely comprises at least one manipulator, a mechanical tone generator and an electronic supporting system. The human player can learn a target position on a track of the at least one manipulator with the assistance of the electronic supporting system.

In case where the at least one manipulator serves as a damper pedal in an acoustic piano, the target position may be an entrance of a half pedal region or an exit from the half pedal region. In case where the at least one pedal serves as a soft pedal in an acoustic piano, the target position may be a certain pedal position between a pedal position where a hammer is opposed to all of the wires of a string and another pedal position where a hammer is opposed to lessened number of wires of the string. In case where the at least one manipulator serves as a key of an acoustic piano, the target position may be a let-off point where a hammer escapes from a jack of an action unit.

In detail, the at least one manipulator is moved by the human player from a rest position to an end position through a track for designating an attribute of tones, and the mechanical tone generating system is connected to the aforesaid at least one manipulator for producing the tones having the attribute.

The electronic supporting system includes an actuator, a sensor and a controller. The actuator is provided for the aforesaid at least one manipulator, and is responsive to a driving signal for exerting an assisting force on the aforesaid at least one manipulator so as to make load for moving the aforesaid at least one manipulator on the track sharable between the human player and the actuator. The sensor monitors the aforesaid at least one manipulator, and produces a detecting signal representative of an actual physical quantity expressing movements of the aforesaid at least one manipulator on the track.

The controller is connected to the sensor and the actuator. The controller checks the actual physical quantity to see whether the aforesaid at least one manipulator reaches the target position on the track for producing an answer, and varies a magnitude of driving signal depending upon the answer for changing a part of the load borne by the human player at the target position.

Thus, the electronic supporting system informs the human player of the target position on the track through the change of load. For this reason, the human player can continuously read a music score in the performance.

In the following description, term "front" is indicative of a position closer to a human player, who sits on a stool for fingering, than a position modified with term "rear". A line, which is drawn between a front position and a corresponding rear position, extends in "fore-and-aft direction", and a lateral direction" crosses the fore-and-aft direction at right angle. An "up-and-down" direction is perpendicular to a plane defined by the fore-and-aft direction and lateral direction.

First Embodiment

Referring first to FIG. 1 of the drawings, an automatic player piano 100 embodying the present invention largely comprises a grand piano 1, an automatic playing system 20 and an electronic supporting system 30. A human player forgers and pedals on the grand piano 1 for a performance as similar to a standard grand piano. While the human player is performing a music tune on the grand piano 1, acoustic tones are generated in response to the fingering, and the human player selectively gives artificial expressions to the acoustic tones through the pedaling.

The automatic playing system 20 is installed inside the grand piano 1, and the acoustic tones are reproduced along a music passage, which a set of music data codes express, without the fingering and pedaling of the human player. In the following description, the automatic playing system 20 is sometimes personified as "automatic player", and the automatic player is labeled with the reference same as that of the automatic playing system, i.e., 20.

System components of the electronic supporting system 30 are shared with the automatic playing system 20 as will be hereinlater described in detail, and the electronic supporting system 30 assists a human player accurately to learn the pedaling for the half stroke. Since the system components are shared between the automatic playing system 20 and the electronic supporting system, the electronic supporting system 30 does not make the structure of automatic player piano 100 complicated.

Structure and Behavior of Upright Piano

Figure 2:
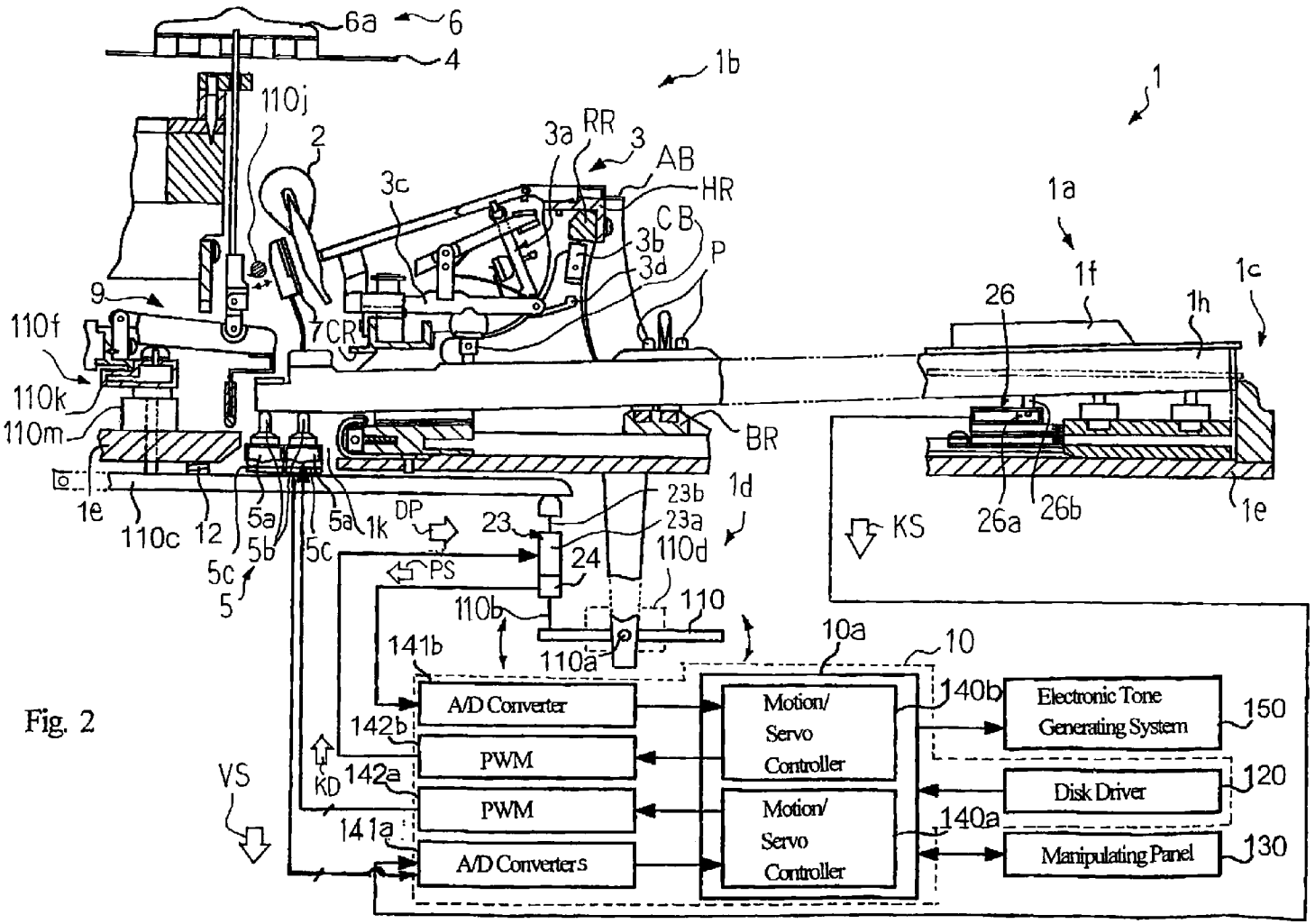
FIG. 2 is a cross sectional side view showing a mechanical tone generating system and an electronic system both incorporated in the automatic player piano.

Description is made on the grand piano 1 with the concurrent reference to FIGS. 1 and 2. The grand piano 1 is broken down into a keyboard 1*a*, a mechanical tone generating system 1*b*, a piano cabinet 1*c* and a pedal system 1*d*. The piano cabinet 1*c* has a key bed 1*e*, which horizontally projects, and the key board 1*a* is mounted on the key bed 1*e*. Legs downwardly project from the key bed 1*e*, and keep the piano cabinet 1*c* spaced from a floor. An inner space is defined in the piano cabinet 1*c*.

Plural black keys 1*f* and plural white keys 1*h* are incorporated in the keyboard 1*a*, and are independently moved between rest positions and end positions. In this instance, the total number of black keys 1*f* and white keys 1*h* is eighty-eight. The end positions are spaced from the rest position by a predetermined distance. The black keys 1*f* and white keys 1*h* are laid on the well known pattern. The black keys 1*f* and white keys 1*h* are depressed for a note-on key event, i.e., generation of an acoustic tone, and are released for a note-off key event, i.e., decay of the acoustic tone.

A balance rail BR extends in the lateral direction on the key bed 1*e*, and the black keys 1*f* and white keys 1*h* are held in contact with the balance rail BR at intermediate positions thereof. Balance pins P upwardly project from the balance rail BR at intervals, and offer fulcrums to the keys 1*f* and 1*h*, respectively. In the following description, the terms "front portions" and "rear portions" of keys 1*f* and 1*h* are determined with respect to the balance rail BR.

When a human player depresses the front portions of keys 1*f* and 1*h*, or when the automatic player 20 pushes up the rear portions of keys 1*f* and 1*h*, the keys 1*f* and 1*h* start to travel from the rest positions to the end positions. On the other hand, the human player and automatic player 20 remove the force from the front portions of keys 1*f* and 1*h* and the rear portions of keys 1*f* and 1*h*, the keys 1*f* and 1*h* start to travel toward the rest positions.

In the following description, term "depressed key" means the black key 1*f* or white key 1*h*, which starts to travel toward the end position, and term "released key" means the black key 1*f* or white key 1*h*, which starts to travel toward the rest position.

The pitch names of a scale are respectively assigned to the keys 1*f* and 1*h* so that the human player and automatic player 20 specify the acoustic tones to be produced through the keys 1*f* and 1*h*. Key numbers are assigned to the pitch names, respectively so that each of the black keys 1*f* and white keys 1*h* is specified with a key code expressing the key number.

Capstan buttons CB project from the rear portions of keys 1*f* and 1*h*, and the movements of keys 1*f* and 1*h* are transmitted from the capstan buttons CB to the mechanical tone generating system 1*b*. Thus, each of the depressed keys 1*f* and 1*h* activates the mechanical tone generating system 1*b*, and causes the mechanical tone generating system 1*b* to generate the acoustic tone at the specified pitch.

The mechanical tone generating system 1*b* and certain component parts of pedal system 1*d* are provided inside the cabinet 1*c*. Three pedals 112, 111 and 110 projects from a pedal box 110*d*, which is hung from the key bed 1*e*, and are named as "soft pedal", "sostenuto pedal" and "damper pedal", respectively. The soft pedal 112, sostenuto pedal 111 and damper pedal 110 are selectively depressed by a human player or the automatic player 20 so as to impart artificial expression to the acoustic tones through a soft pedal linkwork, a sostenuto pedal linkwork and a damper pedal linkwork 110*f*. The pedal system 1*d* is connected to the mechanical tone generating system 1*b* so that the movements of soft, sostenuto and damper pedals 112, 111 and 110 are transmitted to the mechanical tone generating system 1*b* for imparting the effects to the acoustic tones.

While a human player and the automatic player 20 do not exert any force on the soft pedal 112, sostenuto pedal 111 and damper pedal 110, those pedals 112, 111 and 110 stay in "rest positions". When the human player or automatic player 20 depresses the soft pedal 112, sostenuto pedal 111 or damper pedal 110 to the bottom dead point, the pedal 112, 111 or 110 reaches "end position". Thus, the terms "rest position" and "end position" are used for the black keys 1*f*, white keys 1*h*, soft pedal 112, sostenuto pedal 111 and damper pedal 110.

The mechanical tone generating system 1*b* includes hammer assemblies 2, action units 3, strings 4 and a damper mechanism 6. The black keys 1*f* and white keys 1*h* are equal to the action units 3 and to the hammer assemblies 2. In other words, the action units 3 are respectively associated with the keys 1*f* and 1*h*, and the hammer assemblies 2 are respectively associated with the action units 3. In the following description, term "original position" means a position of the component part of the mechanical tone generating system 1*b* while the associated key 1*f* or 1*h* is staying at the rest position. When the black keys 1*f* and white keys 1*h* start to travel toward the end positions, the black keys 1*f* and white keys 1*h* give rise to movements of associated component parts of mechanical tone generating system 1*b*, and the component parts leave the original positions.

The action units 3 are rotatably supported by a center rail CR, which turn is supported by action brackets AB on the key bed 1*e*. The action units 3 are arranged in the lateral direction over the rear portions of keys 1*f* and 1*h*, and are similar in structure one another. Each of the action units 3 includes a jack 3*a*, a regulating button 3*b* and a whippen assembly 3*c*. The whippen assembly 3*c* is rotatably connected to the center rail CR, and the jack 3*a* is rotatably connected to the whippen assembly 3*c*. The regulating button 3*b* is hung from a regulating rail RR, which is bolted to a hammer shank rail HR, and is opposed to a toe 3*d* of the associated jack 3*a*.

The action units 3 are respectively connected to the keys 1*f* and 1*h* so that the depressed keys 1*f* and 1*h* actuate and drive the associated action units 3 for rotation. The actuated action units 3 are rotated from the original positions thereof, and give rise to rotation of the associated hammer assemblies 2.

The hammer assemblies 2 are also arranged in the lateral direction over the action units 3, and are rotatably supported by the hammer shank rail HR. The hammer shank rail HR extends in the lateral direction, and are supported by the action brackets AB. The hammer assemblies 2 are respectively connected to the action units 3 by means of jacks 3*a*, which form parts of the action units 3, and the jacks 3*a* kicks the associated hammer assemblies 2 through the let-off, i.e., escape of the jacks 3*a* from the hammer assemblies 2. Thus, the hammer assemblies 2 start free rotation through the let-off. The hammer assemblies 2 are brought into collision with the strings 4 at the end of free rotation, and give rise to the acoustic tones through the vibrations of strings 4. The action units 3 further includes back checks 7, and the back checks 7 upwardly project from the rear portions of keys 1*f* and 1*h*. When the hammer assemblies 2 rebound on the strings 4, the hammer assemblies 2 are fallen down, and are captured by the associated back checks 7.

The strings 4 are stretched over the array of hammer assemblies 2, and are designed to generate the acoustic tones at the pitch names of the scale, respectively. The pitch names are identical with the pitch names respectively assigned to the keys 1*f* and 1*h*. For this reason, the pitch names of acoustic tones to be produced are specified by means of the keys 1*f* and 1*h*.

The damper mechanism 6 includes dampers 6 and damper links 9. The damper links 9 are spaced from and brought into contact with the rearmost portions of keys 1*f* and 1*h*, and the depressed keys 1*f* and 1*h* give rise to upward movements of the damper links 9. The dampers 6 are connected to the upper end portions of damper links 9.

While the keys 1*f* and 1*h* are staying at the rest positions, the rearmost portions of keys 1*f* and 1*h* are downwardly spaced from the damper links 9, and the weight of damper mechanism 6 causes the dampers 6*a* to be held in contact with the associated strings 4. The dampers 6*a* prohibit the associated strings 4 from vibrations. The dampers 6*a* stay in prohibiting state.

A human player or the automatic player 20 is assumed to move the keys 1*f* and 1*h* from the rest positions toward the end positions. The rearmost positions of keys 1*f* and 1*h* are firstly brought into contact with the damper links 9, and give rise to the upward movements of associated damper links 9 and, accordingly, dampers 6. The dampers 6*a* start the upward movements, and gradually decrease the force exerted on the strings 4. While the dampers 6*a* are being lightly in contact with the strings 4, the dampers 6*a* permit the strings 4 weakly to vibrate. The dampers 6*a* stay in light contact state.

The depressed keys 1*f* and 1*h* minimizes the force on the strings 4 during the downward movements of keys 1*f* and 1*h*, and finally makes the dampers 6*a* spaced from the strings 4. Then, the dampers 6*a* permit the strings strongly to vibrate, and the strings 4 get ready for generating the acoustic tones. The dampers 6*a* enters spaced state. Thus, the dampers 6*a* change their state from the prohibiting state through the light contact state to the spaced state depending upon the key positions.

While the black keys 1*f* and white keys 1*h* are staying at the rest positions, the action units 3 and hammer assemblies 2 are in the original positions thereof, and the dampers 6*a* stay in the prohibiting state.

A human player or the automatic player 20 is assumed to depress one of the keys 1*f* and 1*h*. The rearmost portion of key 1*f* or 1*h* is brought into contact with the damper link 9, and starts to exert the force on the damper 6*a*. The damper 6*a* changes itself from the prohibiting state to the light contact state. The force is continuously exerted on the damper link 9, and makes the weight of damper 6*a* on the string 4 gradually reduced. When the damper 6*a* is spaced from the string 4, the damper 6*a* enters the spaced state, and the string 4 gets ready for vibrations.

The depressed key 1*f* or 1*h* further gives rise to the rotation of the whippen assembly 3*c* and jack 3*a* of associated action unit 3 about the center rail CR, and the rotating jack 3*a* forces the associated hammer 2 to rotate. The toe 3*d* is getting closer and closer to the regulating button 3*b* during the rotation of whippen assembly 3*c*. When the toe 3*d* is brought into contact with the regulating button 3*b*, the rotation of whippen assembly 3*c* gives rise to the rotation of jack 3*a* about the whippen assembly 3*c*. As a result, the jack 3*a* kicks the hammer assembly 2 through the let-off. The hammer assembly 2 starts the free rotation toward the string 4. Thereafter, the depressed key 1*f* or 1*h* reaches the end position. When the depressed key 1*f* or 1*h* reaches the end position, the back check 7 gets close to the string 4.

The hammer assembly 2 flies over the distance, and is brought into collision with the string 4 at the end of free rotation. The string 4 vibrates, and the acoustic tone is generated through the vibrations of string 4.

The hammer assembly 2 rebounds on the string 4, and is dropped. As described hereinbefore, when the depressed key 1*f* or 1*h* reaches the end position, the back check 7 becomes close to the string 4. For this reason, the hammer assembly 2 is landed on the back check 7.

When the human player or automatic player 20 releases the depressed key 1*f* or 1*h*, the released key 1*f* or 1*h* starts to return to the rest position, and the rear portion of key 1*f* or 1*h* is sunk. The rear portion of released key 1*f* or 1*h* permits the whippen assembly 3*c* to rotate in the opposite direction, and the toe 3*d* is spaced from the regulating button 3*b*. For this reason, the jack 3*a* returns to the original position. Since the rearmost portion of released key 1*f* or 1*h* is sunk, the damper link 9 and damper 6*a* are moved in the downward direction due to the weight thereof. The damper 6*a* is brought into contact with the vibrating string 4, and the acoustic tone is decayed.

Thus, the action units 3, hammer assemblies 2, damper mechanism 6 and strings 4 cooperate with one another for generating the acoustic tones, and makes the acoustic tone decayed after the release of keys 1*f* or 1*h*.

The pedal system 1*d* includes the soft pedal 112 and soft pedal linkwork, the sostenuto pedal 111 and sostenuto pedal linkwork, and the damper pedal 110 and damper pedal linkwork 110*f*. The soft pedal 112 is connected through the soft pedal linkwork to the keyboard 1*a*. When the soft pedal 112 is depressed to the end position, the soft pedal linkwork causes the keyboard 1*a* slightly to move in the lateral direction. Each of the most of strings 4 is constituted by plural wires, typically three wires. While the soft pedal 112 is staying at the rest position, the hammer assemblies 2 are aligned with all the plural wires. When each of the hammer assemblies 2 reaches the end of free rotation, the hammer assembly 2 is brought into collision with all of the plural wires. However, when the soft pedal 112 is depressed to the end position, the hammer assemblies 2 are offset from the plural wires. In this situation, the depressed key 1*f* or 1*h* makes the hammer assembly 2 brought into collision with selected ones of wires. For this reason, the loudness of acoustic tones is lessened.

The sostenuto pedal 111 is connected to one end of the sostenuto pedal linkwork, and a sostenuto rod 110*j* is the last link of the sostenuto pedal linkwork. While the sostenuto pedal 111 is staying at the rest position, the sostenuto rod 110*j* does not interfere in the upward movements and downward movements of the damper links 9. However, when the sostenuto pedal 111 is depressed to the end position, the sostenuto rod 110*j* is rotated, and interferes in the downward movements of damper links 9. While all the keys 1*f* and 1*h* are staying at the rest positions, the sostenuto rod 110*j* does not have any influence on the damper links 9. However, if one of or selected ones of the dampers 6*a* have already spaced from the strings 4 before the step-down of the sostenuto pedal 111, the sostenuto rod 110*j* does not permit the damper link or damper links 9 associated with the spaced dampers 6*a* to return to the original position or original positions. Thus, the sostenuto pedal 111 makes the acoustic tones selectively prolonged.

The damper pedal 110 is rotatably supported inside the pedal box 110*d*, and a pin 110*a* gives an axis of rotation to the damper pedal 110. A human player puts his or her foot on the front portion of the damper pedal 110, and exerts force on the front portion of damper pedal 110. Then, the damper pedal 110 is rotated about the pin 110*a* as indicated by arrows in FIG. 2. As a result, the front portion of damper pedal 110 is lowered, and the rear portion of damper pedal 110 is lifted.

The damper pedal linkwork 110*f* includes a pedal rod 110*b*, a pedal lever 110*c*, a damper rail 110*k* and a pedal lever spring 12. The pedal rod 110*b* is connected at the lower end thereof to the rear portion of damper pedal 110 and at the upper end thereof to the pedal lever 110*c*, and the pedal lever 110*c* is connected to the damper rail 110*k* through a dag 110*m*. The pedal lever spring 12 is provided between the key bed 1*e* and the pedal lever 110*c*, and urges the pedal lever 110*c* in the downward direction at all times. The weight of damper mechanism 6 is exerted on the damper rail 110*k*, and is transferred to the pedal lever 110*c*. For this reason, the pedal lever is urged in the downward direction due to the weight of damper mechanism 6 and the elastic force of damper lever spring 12. The weight and elastic force is further transmitted from the pedal lever 110*c* through the pedal rod 110*b* to the rear portion of damper pedal 110 so that the damper pedal 110 is urged toward the rest position at all times.

When a human player depresses the damper pedal 110 against the weight of damper mechanism 6 and the elastic force of pedal lever string 12, the front portion of damper pedal 110 is sunk, and the rear portion of damper pedal 110 is lifted. The upward movement of rear portion of damper pedal 110 is transferred through the pedal rod 110*b* and pedal lever 110*c* to the damper rail 110*k*, and the damper rail 110*k* is lifted. The damper rail 110*k* pushes the damper links 9 in the upward direction so as to make the dampers 6*a* gradually spaced from the strings 4.

As described hereinbefore, the dampers 6*a* are changed between the prohibiting state and the spaced state through the light contact state. The damper pedal 110 gives rise to the change of damper state, and, accordingly, the damper pedal stroke is divided into three regions. While the damper pedal 110 is staying at the rest position or is moved from the rest position to the first boundary, i.e., in the first region, the dampers 6*a* are found in the prohibiting state, and the first region is referred to as "non-effective region". While the damper pedal 110 is being found from the first boundary to the second boundary, i.e., the second region, the damper pedal linkwork 110*f* keeps the dampers 6*a* in the light contact state, and the second region is referred to as "half pedal region". If the damper pedal 110 is found in the third region, i.e., from the second boundary to the end position, the damper pedal linkwork 110 keeps the dampers 6*a* spaced from the strings 4, and the third region is referred to as "effective region."

System Configuration of Automatic Playing System

The automatic playing system 20 comprises an array of solenoid-operated key actuators 5, a controller 10, solenoid-operated pedal actuators 23, pedal sensors 24, an array of key sensors 26 and a manipulating panel 130 (see FIG. 1). An electronic tone generating system 150 is further connected to the controller 10. The electronic tone generating system 150 includes an electronic tone generator and a sound system, and electronic tones are produced on the basis of music data codes through the electronic tone generating system 150 with the assistance of controller 10. In this instance, the music data codes are prepared in accordance with MIDI (Musical Instrument Digital Interface) protocols. The music data codes, which express the note-on events and note-off event, are referred to as "key event data codes", and music data codes, which express pedal on events and pedal-off events, are referred to as "pedal event data codes". Term "key event" means either note-on event or note-off event. In other words, both of the note-on event and note-off event are generalized to the key event. The pedal-on event and pedal-off event are also generalized to "pedal event". The music data code, which expresses a lapse of time from a key event/pedal event to the next key event/pedal event, is referred to as "a duration data code." The pedal event data codes may be given as control change messages defined in the MIDI protocols.

The controller 10 is embedded in the key bed 1*e* as shown in FIG. 1, and the front panel of controller 10 is exposed to users. A disk driver 120 and an information processing system 10*a* are incorporated in the controller 10, and the information processing system 10*a* is electrically connected to the solenoid-operated actuators 5, solenoid-operated pedal actuators 23, pedal sensors 24, key sensors 26, disk driver 120 and manipulating panel 130. A human player loads a disk plate DK such as, for example, a DVD (Digital Versatile Disk) or a CD (Compact Disk) into the disk driver 120, and changes the disk plate DK to another disk plate. In this instance, sets of music data codes are stored in the disk plate DK as standard MIDI files. When a disk plate DK is loaded into the disk driver 120, the table of contents is read out from the disk plate DK, and is transferred to the controller 10*a*.

The manipulating panel 130 is put on the piano cabinet 1*c* beside a music rack 1*j*. The manipulating panel 130 includes a touch screen. The touch screen is a combination between a visual image reproducing device such as, for example, a liquid crystal display panel and a detector overlapped with a screen of the visual image reproducing device. The liquid crystal display panel produces various visual images such as, messages, a job list, a menu of music tunes, switches and levers on the screen with the assistance of the information processing system 10*a*. When a user brings the finer into contact with an area of the screen, the detector reports the location of the area to the information processing system 10*a*, and the information processing system 10*a* determines the visual image produced in the area. If the visual image expresses jobs in several areas on the screen, the information processing system 10*a* specifies the job instructed by the user. The human player further pushes his or her finger on and moves the finger on the visual images expressing the switches and levers on the screen so as to give user's instructions, user's options and user's selection to the automatic playing system 100*b*. Thus, the manipulating panel 130 serves as a man-machine interface.

Figure 3:
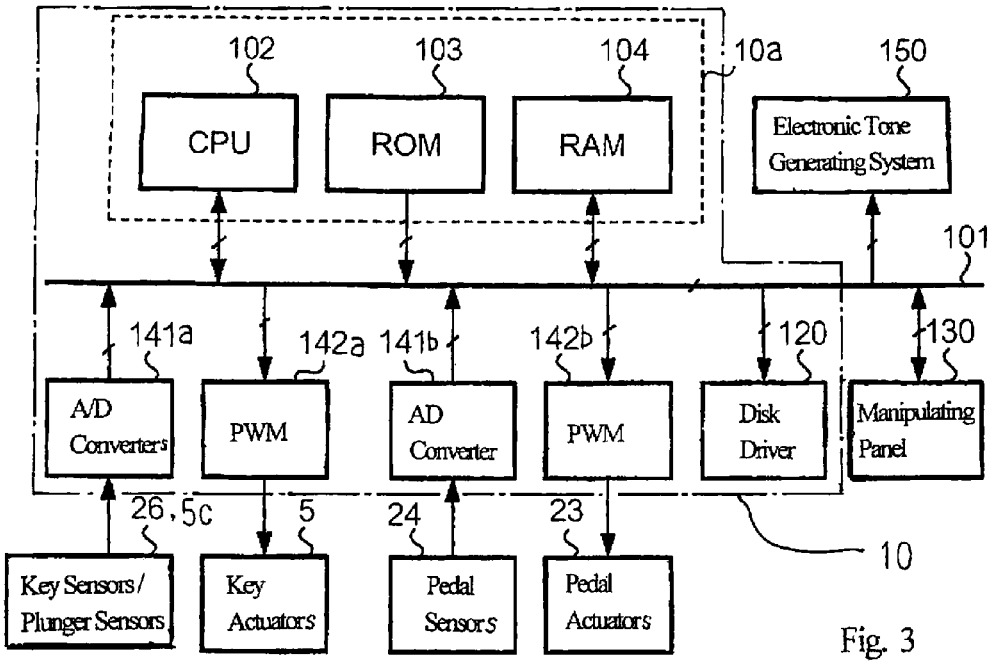
FIG. 3 is a block diagram showing the system configuration of a controller incorporated in the automatic player piano.

Turning to FIG. 3 of the drawings, the controller 10*a* further includes analog-to-digital converters 141*a* and 141*b*, which are abbreviated as "A/D converter", and pulse width modulators 142*a* and 142*b*, which are abbreviated as "PWM", and the information process system 10*a* is connected to the analog-to-digital converters 141*a* and 141*b*, pulse width modulators 142*a* and 142*b* and disk driver 120 through a shared bus system 101. The information processing system 10*a* is further connected to the manipulating panel 130 and electronic tone generating system 150 through the shared bus system 101 and suitable signal interfaces (not shown). Thus, the information processing system 10*a* is communicable with the system components 141*a*, 141*b*, 142*a*, 142*b*, 120, 130 and 150 through the shared bus system 101.

The information processing system 10*a* includes a central processing unit 102, which is abbreviated as "CPU", peripheral processors (not shown), a read only memory device 103, which is abbreviated as "ROM", a random access memory device 11*c*, which is abbreviated as "RAM", and internal clocks, i.e., an oscillator, frequency dividers and counters (not shown). Several internal clocks may be implemented by software.

The central processing unit 102 is an origin of information processing capability of the controller 10, and a computer program runs on the central processing unit 102 so as to achieve jobs expressed by the computer program. The central processing unit 102 is supported by the peripheral processors such as a direct memory access controller and a video processor.

A part of the read only memory device 103 is implemented by semiconductor flash memory devices. Various sorts of information are stored in the read only memory device 11*b* in the non-volatile manner. However, the data stored in the semiconductor flash memory are rewritable. A set of instruction codes, which forms the computer program, is one of the various sorts of information. A subroutine program is designed for automatic performances, and another subroutine program is designed for assistance to musician in pedaling.

A pedal stroke table, in while a relation between the pedal stroke of damper pedal 110 and a variable of is defined, is also stored in the read only memory 103, and is accessed in the assistance to the musician in pedaling. The pedal stroke table will be hereinlater described in detail in conjunction with the electronic supporting system 30.

The random access memory device 104 serves as a working memory, and data tables, registers, flags and software clocks are defined in the random access memory 104. Pieces of key position data and pieces of plunger velocity data are stored in one of the data tables in a rewritable manner. A memory location is assigned to each of the keys 1*f* and 1*h* in the data table for keys, and a predetermined number of pieces of key position data and a predetermined number of pieces of plunger velocity data are stored in the memory location in a first-in first-out manner. Similarly, pieces of pedal position data, which express the actual pedal positions of the soft, sostenuto and damper pedals 112, 111, 110, are stored in another data table during an automatic performance in a first-in first-out manner.

One of the registers is assigned to a piece of pedal position data, and the piece of pedal position data, which expresses an actual pedal position of the damper pedal 110, is stored in the register for assistance to musician in pedaling. The piece of pedal position data is periodically rewritten so that the register keeps the latest actual pedal position. Other registers serve as data buffer registers, and the amount of mean current is stored for each of the solenoid-operated key actuators 5 and solenoid-operated pedal actuators 23.

One of the flags expresses a request for automatic performance through acoustic tones, and is raised when a user instructs the automatic playing system 20 to reproduce a performance on a set of music data codes. Another flag expresses a request for automatic performance through electronic tones, and is raised after selection of the automatic performance through electronic tones. Yet another flag, which is hereinafter referred to as "assist mode flag", expresses a request for assistance to musician in pedaling, and is raised when a user instructs the electronic supporting system to give the assistance to a musician in pedaling. While the flags are being raised, the flags have value of 1. On the other hand, when the flags are taken down, the flags are changed to zero.

The table of contents is transferred from the disk plate 120, and is stored in a certain memory location. When a user specifies a music tune, a set of pieces of music data, which are expressed by the music data codes, is transferred from the disk driver 120 to the random access memory 104 for the automatic performance. Pieces of reference key trajectory data and pieces of reference pedal trajectory data are determined for the keys 1*f* and 1*h* and pedals 110, 111, 112, and are temporarily stored in the random access memory 104 for driving the keys 1*f* and 1*h* and pedals 110, 111 and 112 in the automatic performance. Thus, the random access memory 104 offers a temporary data storage to the central processing unit 102, and calculation results are further stored in the random access memory devices 104.

In case where the computer program is downloaded from a program source through a communication network, the computer program is temporarily stored in the random access memory 104.

One of the internal clocks measures a lapse of time from the initiation of automatic performance, and another internal clock measures the lapse of time from a key event to the next key event. In case where the internal clocks are implemented by software, the internal clocks are defined in the random access memory 104.

The analog-to-digital converters 141*a* are selectively connected to the key sensors 26 and built-in plunger sensors 5*c*, and key position signals KS and plunger velocity signals VS are supplied to the analog-to-digital converters 141*a*. The pieces of key position data are converted from the analog form to the digital form, and pieces of plunger velocity data are also converted from the analog form to the digital form. The pieces of digital key position data and pieces of digital plunger velocity data are periodically fetched by the central processing unit 102, and are written in the data table for keys.

The analog-to-digital converter 141*b* is connected to the pedal sensors 24, and pedal position signals PS are supplied to the analog-to-digital converters 141*b*. The pieces of pedal position data are converted from the analog form to the digital form. The pieces of digital pedal position data are also periodically fetched by the central processing unit 102, and are stored in the data table for pedals. The pedal position signals PS is representative of the pedal stroke from the rest positions. When the pedals 110, 111 and 112 are staying at the rest positions, the values of pedal position signals PS are zero. While the pedals 110, 111 and 112 are being depressed, the values of pedal position signals PS are increased together with the pedal strokes.

The pulse width modulators 142*a* are connected to the solenoid-operated key actuators 5, and selectively supply driving signals DK to the solenoid-operated key actuators 5. The pulse width modulator 142*a* are responsive to pieces of control data expressing the amount of mean current so as to adjust the driving signal DK to a duty ratio equivalent to the amount of mean current. In this instance, the driving signal DK is a pulse train, and the pulse width modulator 142*a* varies the number of pulses per unit time for regulating the amount of mean current. The solenoid-operated key actuators 5 exert force on the associated keys 1*f* and 1*h*, and the magnitude of force is proportional to the amount of mean current of the driving signal DK. Thus, the information processing system 10*a* controls the keys 1*f* and 1*h* in velocity by means of the pulse width modulator 142*a*.

The other pulse width modulators 142*b* are connected to the solenoid-operated pedal actuators 23, and selectively supplies driving signals DP to the solenoid-operated pedal actuators 23. The pulse width modulator 142*b* are responsive to pieces of control data expressing the amount of mean current so as to adjust the driving signal DP to a duty ratio equivalent to the amount of mean current. The driving signal DP is the pulse train, and the pulse width modulator 142*b* also varies the number of pulses per unit time for regulating the amount of mean current. The solenoid-operated pedal actuators 23 exert force on the associated pedals 110, 111 and 112, and the magnitude of force is proportional to the amount of mean current of the driving signal DP. Thus, the information processing system 10*a* controls the pedals 110, 111 and 112 by means of the pulse width modulator 142*b*.

Turning back to FIG. 2, the solenoid-operated key actuators 5 are supported by the key bed 1*e*, and are exposed to the space under the rear portions of keys 1*f* and 1*h* through a slot 1*k* formed in the key bed. The solenoid-operated key actuators 5 are arrayed in lateral direction in a staggered manner, and are respectively associated with the keys 1*f* and 1*h*.

The solenoid-operated key actuators 5 are similar in structure to one another, and each of the solenoid-operated key actuators 5 has a coil 5*a*, a plunger 5*b* and the built-in plunger sensor 5*c*. The coils 5*a* are connected to the pulse width modulator 142*a*, and produce an electromagnetic field in the presence of the driving signals DK flowing therethrough. The plungers 5*b* are provided in the associated coils 5*a*, and are slightly spaced from the lower surfaces of rear portions of keys 1*f* and 1*h* at their original positions, i.e., in the absence of the driving signals DK. While the driving signal DK is flowing through the associated coil 5*a*, the plunger 5*b* upwardly projects from the coil 5*b*, and pushes the rear portion of associated key 1*f* or 1*h*. Thus, the black keys 1*f* and white keys 1*h* are moved from the rest positions toward the end positions by means of the solenoid-operated key actuators 5 instead of the fingers of a human player. As described hereinbefore, the solenoid-operated key actuator 5 exerts the force, which is proportional to the amount of mean current, i.e., the value of duty ratio, on the rear portion of associated key 1*f* or 1*h* by means of the plunger 5*b*. When the driving signal DK is removed from the coil 5*a*, no electromagnetic force is produced through the coil 5*a*, and the plunger 5*b* is retracted into the coil 5*a*. As a result, the black keys 1*f* and white keys 1*h* return to the rest positions.

The built-in plunger sensors 5*c* monitor the plungers 5*b* of associated solenoid-operated key actuators 5, and convert the plunger velocity to the plunger velocity signals VS. The plunger velocity signals VS are supplied to the analog-to-digital converters 141*a*. The built-in plunger sensor 5*c* is, by way of example, implemented by a combination of a piece of permanent magnet and a coil.

The key sensors 26 are similar in structure to one another, and each of the key sensors 26 is implemented by a combination of a photo coupler 26*a* and an optical modulator 26*b*. The photo coupler 26*a* is provided over the key bed 1*e* by means of a frame, and has a light emitting device such as, for example, a photo diode and a light detecting device such as, for example, a photo transistor spaced from the photo diode. A light beam is radiated from the light emitting device to the light detecting device. The optical modulator 26*b* is hung from the lower surface of the front portion of associated key 1*f* or 1*h*, and is moved between the gap between the light emitting device and the light detecting device in the up-and-down direction. The transparency is varied on the optical modulator in the up-and-down direction. The cross section of light beam is so wide that the trajectory of optical modulator 26*b* is fallen within the cross section. The light beam passes through the optical modulator 26*a*, and the amount of incident light on the light detecting device is varied depending upon the transparency of optical modulator 26*b*. Since the optical modulator 26*b* is moved together with the associated key 1*f* or 1*h*, the amount of incident light is varied together with the key position, and, for this reason, expresses the current position of associated key 1*f* or 1*h*. The photo couplers 26*a* are connected to the analog-to-digital converters 141*a*, and the current key positions are reported from the key sensors 26 to the analog-to-digital converters 141*a* through key position signals KS.

The solenoid-operated pedal actuators 23 are respectively provided for the three pedals 110, 111 and 112, and each of the solenoid-operated pedal actuators 23 includes coil 23*a* and a plunger 23*b*. The coils 23*a* are supported by a stationary part such as, for example, the pedal box 110*d*, and the pulse width modulators 142 are connected to the coils 23*a* of solenoid-operated pedal actuators 23, respectively for supplying the driving signals DP. Each of the plungers 23*b* is connected at the lower end thereof to the upper end of pedal rod, and the upper end of plunger 23*b* is slightly spaced from the lower surface of pedal lever 110*c*. While the driving signal DP is flowing through the coil 23*a*, electromagnetic field is created around the coil 23*a*, and the plunger 23*b* upwardly projects from the coil 23*a*. The plunger 23*b* pushes the pedal lever 110*c* upwardly, and makes the damper 6*a* lifted. When the driving signal DP is removed from the coil 23*a*, no electromagnetic force is exerted on the plunger 23*b*, and the weight and elastic force of spring 12 make the pedal linkworks and pedals 110, 111 and 112 return to the original positions and rest positions.

The pedal sensors 24 monitor the plungers 23*b*, and produce pedal position signals PS. The pedal position signals PS are representative of current positions of plungers 23*b* and, accordingly, the current positions of pedals 110, 111 and 112, and are supplied to the analog-to-digital converters 141*b*. Each of the pedal sensors 24 may be implemented by the combination of photo coupler and optical modulator.

System Configuration of Electronic Supporting System

The electronic supporting system 30 gives the assistance to the damper pedal 110, and includes the information processing system 10*a*, analog-to-digital converter 141*b* for the damper pedal 110, pulse width modulator 142*b* for the damper pedal 110, solenoid-operated pedal actuator 23 for the damper pedal 110 and pedal sensor 24 for the damper pedal 110. Although the system components 10*a*, 141*b*, 142*b*, 23 and 24 of electronic supporting system 30 are shared with the automatic playing system 20, the subroutine program for the assistance in pedaling is different from the subroutine program for automatic performance. In other words, only the subroutine program is tailored for the electronic supporting system 30, and is added to the computer program for automatic player piano. Thus, even if the electronic supporting system 30 is added to the automatic player piano 100, the production cost is not widely increased.

Since the system components 10*a*, 141*b*, 142*b*, 23 and 24 of electronic supporting system 30 are same as those of the automatic playing system 20, no further description is hereinafter incorporated for avoiding undesirable repetition.

Computer Program

Description is hereinafter made on the computer program. The computer program is broken down into a main routine program and subroutine programs. One of the subroutine programs is assigned to the automatic performance through acoustic tones, and another subroutine program is assigned to the automatic performance through electronic tones. Yet another subroutine program is assigned to the assistance to musician in pedaling, and other two subroutine programs are assigned to data gathering and software clocks. The main routine program conditionally and unconditionally branches to the subroutine programs through timer interruptions.

When a user turns on a power switch, the information processing system 10*a* is powered, and the main routine program starts to run on the central processing unit 102. The central processing unit 102 firstly initializes the controller 10, and, thereafter, reiterates the main routine program until the power-off. While the main routine program is running on the central processing unit 102, the central processing unit 102 requests the video processor to produce the job list and prompt message on the touch screen of the manipulating panel 130. The job list contains jobs such as "automatic performance through acoustic tones", "automatic performance through electronic tones", "assistance in pedaling" and so forth. When the user selects the job of "automatic performance through the acoustic tones" or the job of "automatic performance through electronic tones" from the job list, the central processing unit 102 raises the flag for the automatic performance through acoustic tones or the flag for the automatic performance through electronic tones. After the change of flag, the central processing unit 102 accesses the table of contents, and requests the video processor to produce the menu of music tune on the touch screen. When the user selects a music tune from the menu, the standard MIDI file for the selected music tune is transferred from the disk plate DK to the random access memory 104. Upon completion of the data transfer, the main routine program starts periodically to branch to the subroutine program for automatic performance through acoustic tones or the subroutine program for automatic performance through electronic tones. Thus, the automatic playing system 20 or electronic tone generating system 150 gets ready for the automatic performance. Thereafter, the central processing unit 102 requests the video processor to produce visual images of control switches such as a start switch, a stop switch, a fast forward switch, a reverse forward switch, a repeat switch and so forth on the touch screen.

The main routine program periodically branches to the subroutine program for software clock, and increments the lapses of time on the software timers. One of the software timers is used to measure the lapse of time between a key event and the next key event. The duration data codes express the numbers of pulses of tempo clock signal. In other words, the lapse of time between a key event and the next key event is expressed as a number of pulses of the tempo clock signal. The software timer is set to the number of pulses of tempo clock signal, and is counted down in response to the tempo clock signal. When the software timer reaches zero, the central processing unit 102 processes the key event data code or codes, and sets the software clock to the number of pulses of tempo clock signal for the next key event.

In case where the user selects the automatic performance through acoustic tones or the assistance to musician in pedaling from the job list, the main routine program periodically branches to the subroutine program for data gathering. The sorts of data to be gathered are depending upon the job selected by the user. When the user selects the automatic performance through acoustic tones, the central processing unit 102 periodically fetches the pieces of key position data, pieces of plunger velocity data and pieces of pedal position data from the data buffer registers in the analog-to-digital converters 141*a* and 141*b*, and are written in the data tables defined in the random access memory 104. On the other hand, when the user selects the assistance to musician in pedaling from the job list, the central processing unit 102 periodically fetches the pieces of pedal position data from the data buffer register in the analog-to-digital converter 141*b* assigned to the pedal sensor 23 for the damper pedal 110, and transfers the pieces of pedal position data to the random access memory 104. Thus, the sorts of data to be gathered are depending upon the job to be requested.

Subroutine Programs for Automatic Performances

When the flag expressing the automatic performance through electronic tones is raised, the main routine program starts periodically to branch to the subroutine program for automatic performance through electronic tones. The central processing unit 102 sets the software clock to the number pulses expressed by the first duration data. When the software timer reaches zero, the central processing unit 102 transfers the key event data code, pedal event data code or key event data codes for the note-on event, note-on events and pedal-on event from the random access memory 104 to the electronic tone generating system 150, and sets the software timer to the number of pulses expressed by the next duration data code. The electronic tone generator assigns the channel or channels to the key event data code or codes, and makes pieces waveform data sequentially read out from a waveform memory. An audio signal is produced from the pieces of waveform data read out from the waveform memory, and a suitable envelope is given to the audio signal. The audio signal is supplied to the sound system for producing the electronic tone or tones. When the key event data code or codes for the note-off event or events are supplied to the electronic tone generator, the audio signal is decayed for the note-off. The above-described jobs are repeated for all of the music data codes.

When the flag is raised for the automatic performance through acoustic tones, the central processing unit 102 successively sets the software timer to the numbers of pulses, and counts down the software timer as similar to that in the automatic performance through electronic tones. However, the key event data codes and pedal event data codes are supplied to motion controller/servo controllers 140*a* and 140*b* instead of the electronic tone generating system 150. The motion controllers and servo controllers are realized through execution of instruction codes in the subroutine program for automatic performance through acoustic tones, and are hereinafter described in detail.

Description is firstly made on the control on the loudness of tones. The note-on event data codes express not only the pitch of tones to be produced but also the loudness of the tones. The loudness of the tone is proportional to the velocity of hammer immediately before the collision with the string 4, i.e., the final hammer velocity. The central processing unit 102 analyzes the pieces of music data, and determines the keys 1*f* and 1*h* to be depressed and released and the final hammer velocity.

The final hammer velocity is controllable by regulating the key velocity at a reference point to a target value. The key velocity at the reference point is referred to as "a reference key velocity." The reference point is a predetermined key position on trajectories of the keys 1*f* and 1*h* from the rest position to the end position, and the key trajectory is expressed a series of values of target key position varied together with time. The series of values of target key position toward the end position are referred to "a reference forward key trajectory", and term "a reference backward key trajectory" means a series of values of target key position toward the rest position. The reference forward key trajectory is further designed in such a manner that the travel on the reference forward key trajectory results in the tone generation at the note-on time. The reference backward key trajectory is determined for controlling the time at which the tone is decayed, i.e., the note-off time. The reference forward key trajectory and reference backward key trajectory are generalized as "reference key trajectory".

When a piece of music data expresses a large value of loudness of a tone, the black key 1*f* or white key 1*h* for the tone is moved along a steep reference forward key trajectory so as to pass the reference point at a corresponding large value of the reference key velocity. On the other hand, when a piece of music data expresses a small value of loudness of a tone, the automatic playing system makes the black key 1*f* or white key 1*h* to travel on a gentle reference forward key trajectory so that the key 1*f* or 1*h* passes the reference point at a corresponding small value of the reference key velocity. Thus, the central processing unit 102 controls the loudness of tones by adjusting the reference key velocity to target values.

A series of values of target pedal position for pedal-on event is referred to as "a reference forward pedal trajectory", and a series of values of target pedal position for pedal-off event is referred to as "a reference backward pedal trajectory." If the pedal 110, 111 or 112 exactly travels on the reference forward pedal trajectory, the mechanical tone generating system 1*b* gets ready to impart the effect to the tones at a pedal-on time, i.e., the time specified with the pedal-on data code. The reference backward pedal trajectory makes the mechanical tone generating system 1*b* free from the effect at a pedal-off time.

Each of the keys 1*f* and 1*h* is controlled as follows. When the central processing unit 102 finds a key event data code to be processed, the central processing unit 102 determines the key 1*f* or 1*h* to be moved and note-on time/note-off time on the basis of the key event data code. If the key event data code expresses the note-on event, the central processing unit 102 further determines the reference key velocity. Thereafter, the central processing unit 102 prepares the reference key trajectory on the basis of the piece of music data expressing the note-on time/note-off time and the loudness for the note-on event. The method for preparing the reference key velocity is well known to persons skilled in the art, and no further description is hereinafter incorporated for the sake of simplicity.

A target key velocity is determined on a predetermined number of the values of target key position, and the value of target key position and the value of target key velocity are respectively compared with the value of actual key position, which is reported from the key sensor 26, and the value of actual key velocity, which is reported from the plunger sensor 5*c*, and a position difference and a velocity difference are determined through the comparison. The value of position difference and the value of velocity difference are multiplied by a position gain and a velocity gain, and a value is added to the sum of products. The sum of products and value expresses the amount of mean current of driving signal DK for minimizing the positional difference and velocity difference. The piece of control data expressing the amount of mean current is supplied to the pulse width modulator 142*a*, and the driving signal DK is adjusted to a value of duty ratio equivalent to the amount of mean current. The driving signal DK is supplied to the solenoid-operated key actuator 5 for the key 1*f* or 1*h*. The above-described feedback control sequence is periodically repeated so as to force the key 1*f* or 1*h* to travel on the reference key trajectory.

The pedals 110, 111 and 112 are controlled as follows. When the central processing unit 102 finds the music data code expressing the control message for the effect, the central processing unit determines the pedal 110, 111 or 112 to be moved and the pedal-on time/pedal-off time, and prepares the reference pedal trajectory so as to make the mechanical tone generating system 1*b* get ready for imparting the effect at the pedal-on time or release the mechanical tone generating system 1*b* free from the effect at the pedal-off time. A series of values of pedal position is determined toward the pedal-on time or pedal-off time. In this way, the reference pedal trajectory is prepared.

Each of the values of target pedal position is compared with the actual pedal position, which is reported from the pedal sensor 24, and a position difference is calculated through the comparison. The position difference is multiplied with a position gain, and the product is added to a value. The sum expresses the amount of mean current for minimizing the position difference, and the piece of control data expressing the amount of mean current is supplied to the pulse width modulator 142*b*. The driving signal DP is supplied to the solenoid-operated pedal actuator 23, which regulates the electromagnetic force to a desirable value.

The motion controllers stand for the preparation of reference key trajectories and the preparation of reference pedal trajectories, and the servo controllers stand for the feedback control on the keys 1*f* and 1*h* and the feedback control on the pedals 110, 111 and 112. The motion controller/servo controller 10*a* will be described in more detail in conjunction with the assistance to musician for pedaling.

Assuming now that the central processing unit 102 finds a note-on event to be processed, the central processing unit 102 specifies the key 1*f* or 1*h* to be moved, and prepares the reference forward key trajectory for the key 1*f* or 1*h* as the role of motion controller.

As described hereinbefore in conjunction with the subroutine program for data gathering, values of the actual key position and values of the actual plunger position are accumulated in the data table for keys, and the predetermined number of values of actual key position and the predetermined number of values of actual key velocity are periodically renewed in the first-in first-out manner.

The target key velocity is calculated on the basis of the predetermined number of values of target key positions, and the value at the head of reference key velocity and the calculated value of target key velocity are respectively compared with the latest value of actual key position and the latest value of actual key velocity. The amount of mean current is determined on the basis of the position difference and velocity difference as the role of servo controller, and the amount of mean current is transferred to the pulse width modulator 142*a*.

The pulse width modulator 142*b* regulates the driving signal DK to the target value of duty ratio ui equivalent to the amount of mean current. The driving signal DK is supplied to the solenoid-operated key actuator 5 for the key 1*f* or 1*h*, and is converted to the electromagnetic force through the solenoid-operated key actuator 5. The electromagnetic force is exerted on the lower surface of rear position of key 1*f* or 1*h* so that the key 1*f* or 1*h* advances on the reference forward key trajectory.

The key sensor 26 and plunger sensor 5*c* report the latest value of actual key position and the latest value of actual key velocity to the information processing system 10*a*. The latest values enter the queue of the values of actual key position and the queue of the values of actual key velocity, and the oldest values are pushed out from the queues.

The above-described sequence is repeated until the key 1*f* or 1*h* reaches the end of the reference forward key trajectory. The key 1*f* or 1*h* actuates the action unit 3, and makes the hammer assembly 2 start the free rotation through the let-off on the way to the end position of reference forward key trajectory. Since the key 1*f* or 1*h* passes through the reference point at the reference key velocity, the hammer assembly 2 is brought into collision with the string 4 at the target value of final hammer velocity so that the acoustic tone is generated at the target value of loudness.

When the central processing unit 102 finds the key event data code for the note-off, the central processing unit 102 determines the reference backward key trajectory for the key 1*f* or 1*h* to be released. The released key 1*f* or 1*h* makes the damper 6 enter the prohibiting state at the note-off time in so far as the released key 1*f* or 1*h* travels on the reference backward key trajectory, and, accordingly, the acoustic tone is decayed at the note-off time.

The released key 1*f* or 1*h* is forced to travel on the reference backward key trajectory through the role of servo controller, and the acoustic tone is decayed at the note-off time.

In this manner, while the automatic player is performing the selected music tune, the motion/servo controller 140*a* forces the keys 1*f* and 1*h* to travel on the reference key trajectories in cooperation with the pulse width modulators 142*a*, solenoid-operated key actuators 5, key sensors 26, plunger sensors 5*c* and analog-to-digital converters 141*a*. The motion/servo controller 140*a*, pulse width modulator 142*a*, solenoid-operated key actuators 5, key sensors 26, plunger sensors 5*c* and analog-to-digital converters 141*a* form a servo control loop for keys 1*f* and 1*h*.

When the central processing unit 102 finds the music data code expressing the control message for an effect in the automatic performance, the central processing unit 102 prepares the reference forward pedal trajectory as the role of motion controller. The actual pedal position is periodically fetched by the central processing unit 102 through the subroutine program for data gathering so that the latest value of actual pedal position is found in the data register.

The central processing unit 102 successively compares the values of target pedal position with the latest values of actual pedal position, and varies the amount of mean current, which makes the position difference minimized, as the role of servo controller.

The amount of means current is supplied to the pulse width modulator 142*b*, and the pulse width modulator 142*b* adjusts the driving signal DP to the value of duty ratio ui equivalent to the amount of mean current. The driving signal DP is converted to the electromagnetic force through the solenoid-operated pedal actuator 23 so that the pedal 110, 111 or 112 is forced to travel on the reference forward pedal trajectory. As a result, the mechanical tone generating system 1*b* gets ready to impart the music effect to the acoustic tones.

When the central processing unit 102 finds the music data code expressing the pedal-off event, the central processing unit 102 prepares the reference backward pedal trajectory as the role of motion controller, and forces the pedal 110, 111 or 112 to travel on the reference backward pedal trajectory in cooperation with the pulse width modulator 142*b*, solenoid-operated pedal actuator 23, pedal sensor 24 and analog-to-digital converter 141*b*. Thus, the motion/servo controller 140*b*, pulse width modulators 142*b*, solenoid-operated pedal actuators 23, pedal sensors 24 and analog-to-digital converters 141*b* form a servo control loop for pedals 110, 111 and 112.

Subroutine Program for Assistance in Pedaling

When a user selects the assistance to musician in pedaling from the job list, the central processing unit 102 raises the assist mode flag, and the main routine program starts periodically to branch to the subroutine program for assistance to musician in pedaling in so far as the assist mode flag is raised.

Figure 4:
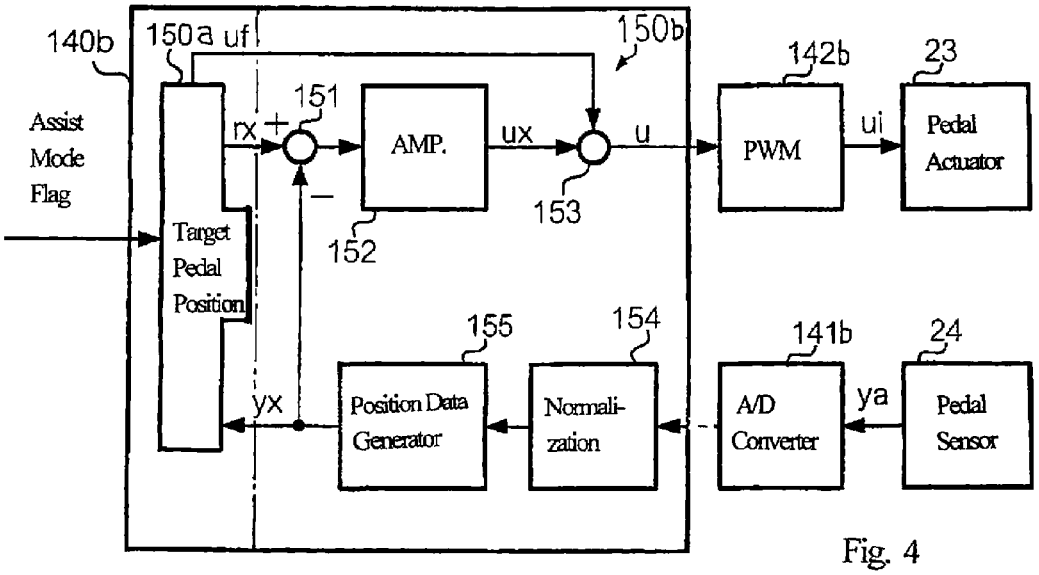
FIG. 4 is a block diagram showing software modules of a motion and servo controller in assistance to musician in pedaling.

First, the motion/servo controller 140*b* is described with reference to FIG. 4. The motion/servo controller 140*b* is broken down into the motion controller 150*a* and the servo controller 150*b*. The first role of motion controller 150*a* is to determine whether or not the assisting force is exerted on the damper pedal 110, and the second role is to determine the reference pedal trajectories, i.e., series of values of target pedal positions rx.

The motion controller 150*a* checks the assist mode flag and automatic performance flag to see what job the user requests. If the assist mode flag is raised, the motion/servo controller 140*b* is operating in an assist mode, and the motion controller 150*a* prepares the reference pedal trajectory for the damper pedal 110 so as make the assistant force exerted on the damper pedal 110.

On the other hand, if the assist mode flag is taken down, the motion/servo controller 140*b* makes the assisting force not exerted on the damper pedal 110 on the condition that the automatic performance flag is also taken down. When both of the assist mode flag and automatic performance flag are taken down, the motion/servo controller 140*b* is operating in a non-assist mode. If the automatic performance flag is raised on the condition that the assist mode flag is taken down, the motion controller 150*a* prepares the reference pedal trajectories for the pedals 110, 111 and 112 for the automatic performance, and supplies the values of target key position data to the servo controller 150*b* as described hereinbefore. Thus, the motion controller 150*a* makes the decision for the first role on the basis of the assist mode flag and automatic performance flag.

The reference pedal trajectory in the assistance to musician in pedaling is different from that in the automatic performance, because the motion controller 150*a* is expected to guide a human player to the half pedal region in the assistance to musician in pedaling. The reference pedal trajectory in the assistance is hereinafter referred to as "reference assisting trajectory" so as to make it distinguishable from the reference pedal trajectories in the automatic performance.

The reference assisting trajectory expresses a series of values of target pedal position rx, which is equal to the actual pedal position yx in both of the assist mode and non-assist mode, and is determined in such a manner that the solenoid-operated pedal actuator 23 does not give resistance against the step-down movement of damper pedal 110 by human players. However, the variable uf is increased in the assist mode until the damper pedal 110 reaches the boundary between the non-effective region and the half pedal region. When the damper pedal 110 reaches the boundary between the non-effective region and the half pedal region, the motion controller 150*a* changes the variable uf to zero. For this reason, the assisting force is not exerted on the damper pedal 110 after the damper pedal 110 reaches the boundary between the non-effective region and the half pedal region. The variable of is fixed to zero in the non-assist mode. For this reason, any electromagnetic force is not exerted on the damper pedal 110.

When the damper pedal 110 reaches the boundary between the non-effective region and the half pedal region, the motion/servo controller 140*b* only causes the plunger of solenoid-operated pedal actuator 23 to follow the damper pedal 110.

The servo controller 150*b* is broken down into five software modules 151, 152, 153, 154 and 155. The software modules 151, 152, 153, 154 and 155 are called as "comparator", "amplifier", "adder", "normalization", "position data generator", respectively.

The pieces of pedal position data are supplied from the analog-to-digital converter 141*b*, and are stored in the random access memory 104. The latest piece of pedal position data ya is read out from the random access memory 104, and is subjected to the normalization through the software module 154. As well know to persons skilled in the art, each product of the grand piano 1 is constituted by a large number of component parts, and the component parts are machined under predetermined values of the tolerance. For this reason, the damper mechanism 6, damper pedal 110 and damper pedal linkwork 110*f* are not strictly equal in dimensions from those of another product of the grand piano 1*b*. Moreover, the position-to-signal converting characteristics of pedal sensor 24 contain a small amount of difference from those of another product of the peal sensor 24. The pieces of pedal position data usually contain error components with respect to those produced through a standard pedal sensor. The error components are eliminated from the pieces of pedal position data through the normalization. In other words, the normalization makes the pedal position data applicable to all of the products of automatic player piano. The normalized piece of pedal position data yx is stored in a pedal position data code, which has a data format same as that of the piece of target pedal position data rx, through the software module 155. The pedal position data code is supplied to the motion controller 150*a* and adder 151.

The motion controller 150*a* checks the pedal position data code to see whether or not the actual pedal position yx is equal to the target pedal position rx. While the damper pedal 110 is traveling on the way to the end position in the assist mode and non-assist mode, the answer is always given affirmative, because the motion controller 150*a* always makes the target key position rx equal to the actual key position yx in both of the assist mode and non-assist mode. However, while the motion/servo controller 150*b* is operating in the automatic performance, the target pedal position rx is usually different from the actual pedal position yx, and a position difference takes place.

The actual pedal position data yx is further compared with the target pedal position data rx through the software module 151. If the actual pedal position yx is equal to the target pedal position rx, the positional difference is zero. However, if the actual pedal position yx is different from the target pedal position rx, the position difference is multiplied by a position gain through the software module 152, and a value of variable uf is added to the product ux through the software module 153. The sum u expresses a target value of the amount of mean current, and is supplied to the pulse width modulator 142*b*.

In the servo control in the automatic performance, the variable uf is greater than that in the assist mode as will be hereinlater described in conjunction with the pedal stroke table. The amount of mean current u is varied together with sum of product ux and variable uf. The pedals 110, 111 and 112 are forced to travel on the reference pedal trajectories.

The variable uf is increased in the assist mode together with the actual pedal position yx until the damper pedal 110 reaches the boundary between the non-effective region and the half pedal region. Although the position difference between the target pedal position rx and the actual pedal position yx does not take place in the assist mode, the variable uf makes the amount of mean current not equal to zero. For this reason, the driving signal DP causes the solenoid-operated pedal actuator 23 to exert the assisting force on the damper pedal 110.

Since both of the position difference and variable uf are zero in the non-assist mode, the amount of means current u is zero, and the solenoid-operated pedal actuator 23 keeps the plunger thereof at the original position.

When the damper pedal 110 reaches the boundary between the non-effective region and the half pedal region in the assist mode, the motion controller 150*a* changes the variable uf to zero. Since the position difference is zero, the amount of mean current u is also reduced to zero, the servo controller 150*b* rapidly reduces the target value of the amount of mean current to zero. As a result, the pulse with modulator 142*b* removes the driving signal DP from the solenoid-operated pedal actuator 23, and the plunger is retracted into the coil of solenoid-operated pedal actuator 23 by virtue of a built-in return spring.

While the motion/servo controller 140*b* is operating under the condition that both of the assist mode flag and automatic performance flag are taken down, the motion controller 150*a* makes the target pedal position rx equal to the actual pedal position yx, and the variable uf is fixed to zero. Any position difference does not take place, and the sum of the product ux and variable uf is zero at all times. For this reason, the plunger stays at the original position, and any assisting force is not exerted on the damper pedal 110.

The reference assisting trajectory is hereafter described with reference to FIGS. 5 and 6. XR, XH and XE are indicative of the rest position, entrance to the half pedal region and end position, respectively. Plots L1 stand for the variable uf in the assist mode, and plots L2 stand for the variable uf in the automatic performance. Comparing the plots L1 with the plots L2, it is understood that the electromagnetic force in the assist mode is less than that in the automatic performance.

While a human player is performing a music tune in the non-assist mode, he or she exerts the foot force, which is as large as the electromagnetic force in the automatic performance, on the damper pedal 110. However, the electronic supporting system 30 exerts part of the electromagnetic force on the damper pedal 110 in the assist mode. For this reason, a human player needs to exert the foot force, which is as large as the difference between the electromagnetic force in the automatic performance and the electromagnetic force in the assist mode, on the damper pedal 110 so as to move the damper pedal 110 as usual. In other words, the human player feels the damper pedal 110 light until the entrance XH of half pedal region. However, the electromagnetic force is rapidly reduced to zero at the entrance. The human player feels the damper pedal 110 heavy. In other words, the load to be borne by the human player is rapidly changed at the entrance XH of half pedal region. Thus, the electronic supporting system 30 makes the human player notice the damper pedal 110 reaching the entrance XH of half pedal region through the change of load.

Figures 5, 6:
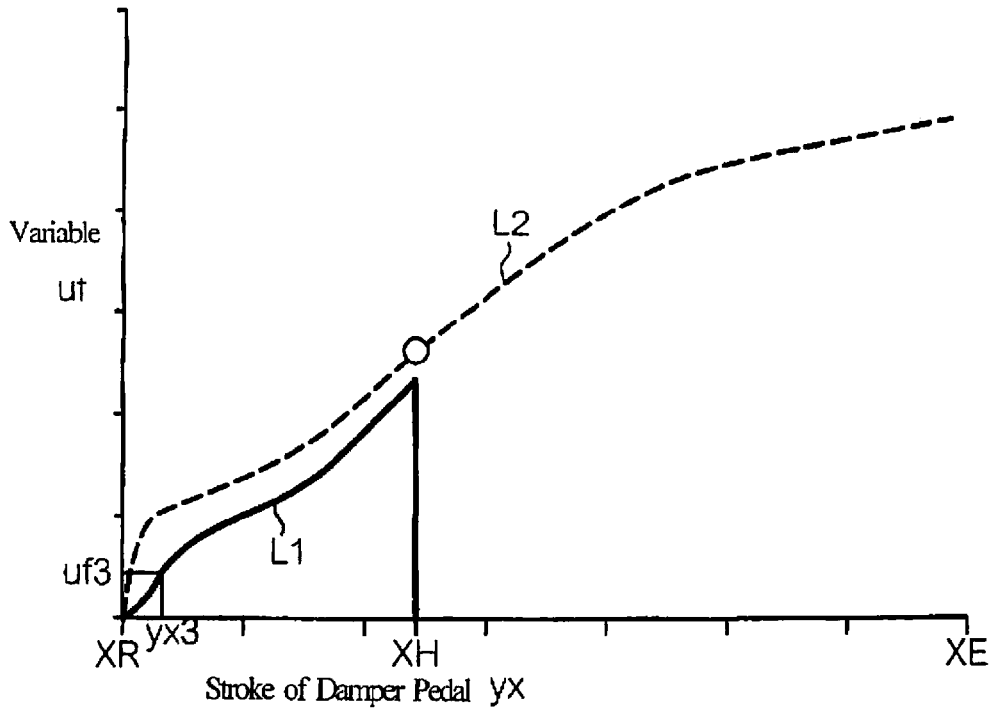
FIG. 5 is a graph showing a relation between the stroke of a damper pedal and a value of a variable used in the assistance to musician in pedaling.
FIG. 6 is a view showing a pedal stroke table used in the assistance to musician in pedaling.

The relation between the actual damper pedal position yx and the variable uf is written in the pedal stroke table defined in the read only memory 103, and FIG. 6 shows the relation. While the damper pedal 110 is staying at the rest position, the variable uf is zero, and the motion/servo controller 140*b* does not drive the solenoid-operated pedal actuator 23. The human player is assumed to start to depress the damper pedal 110. The actual damper pedal position yx is successively varied to yx1, yx2, yx3, . . . . Then, the variable uf is increased to uf1, uf2, uf3, . . . together with the actual pedal position yx. When the damper pedal 110 reaches the entrance XH to the half pedal region, the variable of is rapidly reduced to zero, and is maintained at zero until the end position XE. The human player feels the resistance of damper pedal 110 rapidly increased at the entrance XH to the half pedal region. For this reason, the human player can learn the pedal stroke from the rest position to the entrance XH to the half pedal region with the assistance of the electronic supporting system 30.

Assuming now that a musician selects a standard practice in fingering and pedaling on the grand piano 1 from the job list, the central processing unit 102 keeps the assist mode flag taken down. In other words, the assist mode flag is indicative of non-assist mode. In this situation, the motion controller 150*a* and servo controller 150*b* do not give any assistance in the pedaling on the damper pedal 110.

While the musician is playing a music tune on the grand piano 1, he or she notices some notes being produced at small value of loudness. The musician decides that the damper pedal 110 is moved to the half pedal region. The musical exerts the foot force on the damper pedal 110, and moves the damper pedal 110 toward the half pedal region. Although the damper pedal stroke yx is increased from zero toward the entrance XH of half pedal region, the motion/servo controller 140*b* keeps the plunger of solenoid-operated pedal actuator 23 at the original position. As a result, the musician depresses the damper pedal by his or her foot force only.

The musician is assumed to select the assistance in pedaling from the job list. The central processing unit 102 raises the assist mode flag, and the state of assist mode flag is relayed to the motion controller 150*a*. The motion/servo controller 140*b* operates in the assist mode.

The musician starts to play the music tune on the grand piano 1. While the musician is fingering and pedaling, he or she notices the notes, and decides to depress the damper pedal 110 into the half pedal region.

When the musician depresses the damper pedal 110, the actual pedal position yx is gradually increased from zero through yx1, yx2, yx3, . . . , and the motion controller 150*a* keeps the target pedal position rx equal to the actual pedal position yx1, yx2, yx3, . . . . For this reason, any position difference does not take place, and the product ux is zero. The motion controller 150*a* accesses the pedal stroke table in the read only memory 103, and successively reads out the variable uf1, uf2, uf3, . . . . The values uf1, uf2, uf3, . . . are greater than zero, and the value of variable uf is increased from uf1 through uf2, uf3, . . . . The value of variable uf is added to the product ux. The target amount of mean current u is equal to the value of variable uf. Thus, the target amount of mean current u is determined, and is supplied to the pulse width modulator 142*b*.

The driving signal DP is adjusted to the value of target amount of mean current u, and, thereafter, is supplied to the solenoid-operated pedal actuator 23. The solenoid-operated pedal actuator 23 exerts the electromagnetic force on the damper pedal 110. In other words, the electronic supporting system 30 bears the part of load on the damper pedal 110. The musician feels the damper pedal 110 light, and the electronic supporting system 30 continuously bears the part of load until the entrance XH.

When the damper pedal reaches the entrance XH of half pedal region, the variable uf is rapidly reduced to zero, and the electronic supporting system 30 does not bear the load. In order to make the damper pedal 110 enter the half pedal region, the musician needs to increase the foot force. The musician notices the damper pedal reaching the entrance XH through the change of load on the damper pedal 110.

Figure 7:
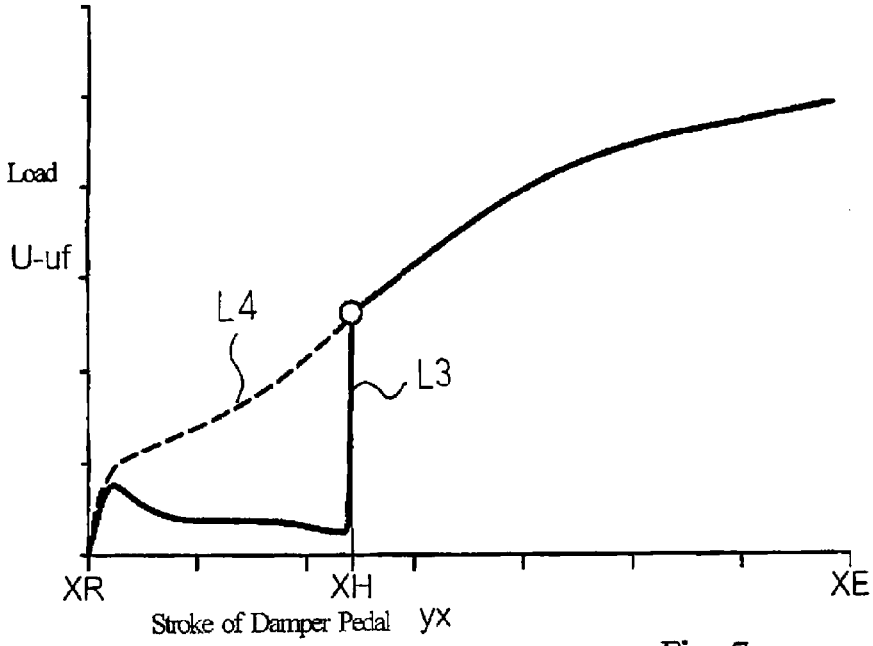
FIG. 7 is a graph showing a relation between the stroke of damper pedal and load borne by a human player.

FIG. 7 shows the load U-uf borne by the musician. Although the damper pedal 110 increases the stroke, i.e., the actual pedal position yx from the rest position XR to end position XE through the entrance XH of half pedal region as indicated by plots L3, the load U-uf is not increased until the entrance XH of half pedal region. Although the total load on the damper pedal 110 is increased until the entrance XH of half pedal region as indicated by broken lines L4, the electronic supporting system 30 bears the difference between the plots L3 and the broken lines L4. For this reason, the musician needs to bear the small amount of load. However, when the damper pedal 110 reaches the entrance XH of half pedal region, the assisting force is reduced to zero, and the musician needs to bear the entire load. Thus, the load to be borne by the musician is rapidly increased at the entrance XH of half pedal region.

As will be appreciated from the foregoing description, the electronic supporting system 30 bears the part of load on the damper pedal 110 until the entrance XH of half pedal region, and rapidly reduces the assisting force at the entrance XH of half pedal region. As a result, the musician feels the change of load through the tactile impression on the sole of foot. This means that the electronic supporting system 30 permits the musician continuously to read the music score. As a result, the musician can learn the pedaling for the half pedal without sacrifice of the fingering on the keyboard 1*a*.

Moreover, the system components of electronic supporting system 30 are shared with the automatic playing system 20, and only the computer program is modified with the subroutine program for assistance to musician in pedaling. Thus, the manufacturer does not widely increase the production cost of automatic player piano 100.

Furthermore, the electronic supporting system 30 is useful in tuning work on the damper pedal 110. Even if the entrance XH of half pedal region is moved from the optimum position, the tuning worker keeps the damper pedal 110 at the entrance with the assistance of the electronic supporting system 30, and adjusts the damper pedal linkwork 110*f* and damper link 9 to the correct state.

Second Embodiment

Figure 8:
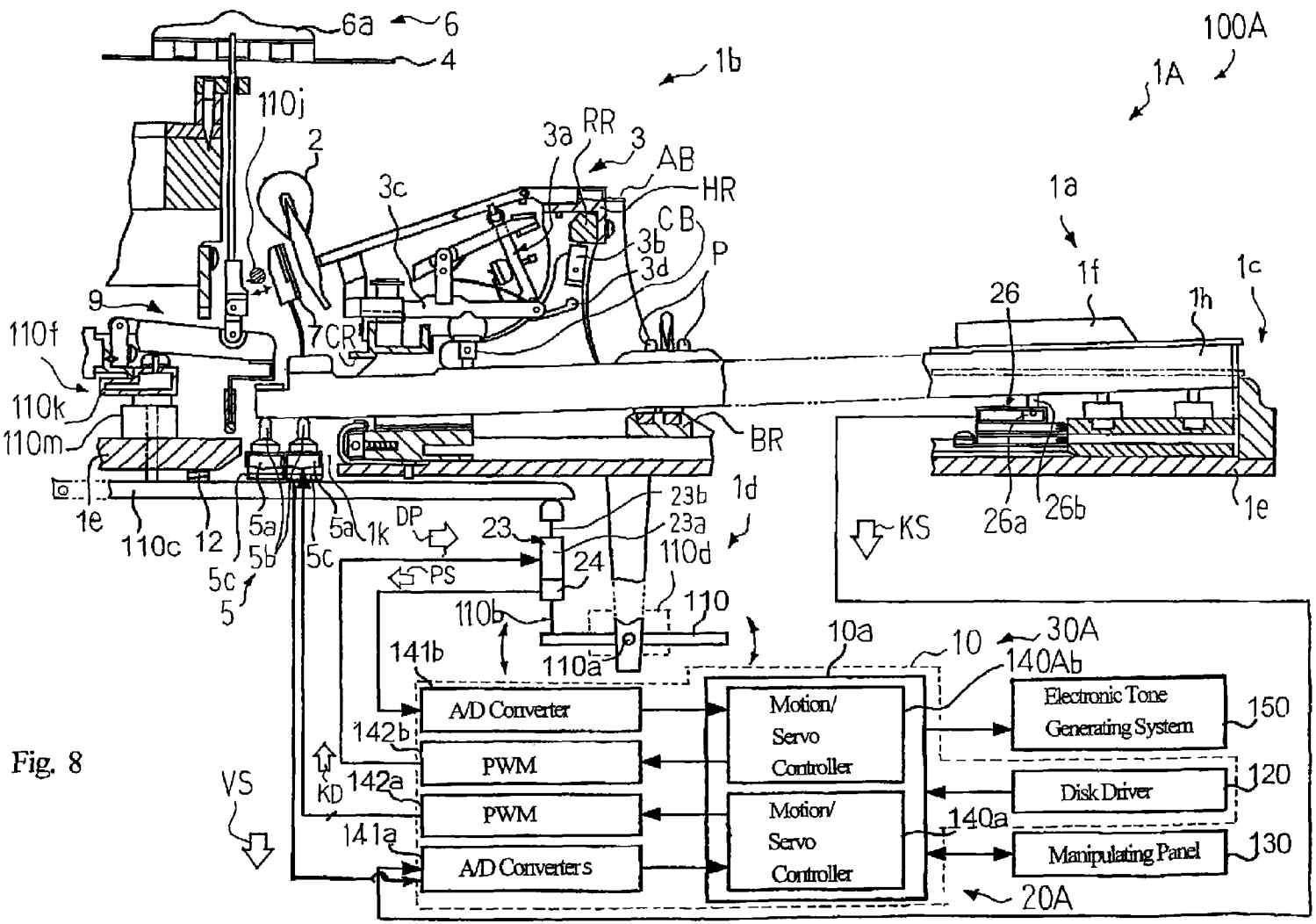
FIG. 8 is a cross sectional side view showing another automatic player piano of the present invention.

Turning to FIG. 8 of the drawings, another automatic player piano 100A embodying the present invention largely comprises a grand piano 1A, an automatic playing system 20A and an electronic supporting system 30A. The grand piano 1A and automatic playing system 20A are similar in structure and operation to the grand piano 1 and automatic playing system 20, and, for this reason, component parts of grand piano 1A and system components of automatic playing system 20A are labeled with references designating the corresponding component parts of grand piano 1 and the system components of automatic playing system 20 without detailed description for the sake of simplicity.

The system components of automatic playing system 20A are also shared with the electronic supporting system 30A. However, the subroutine program for assistance in pedaling is different between the electronic supporting system 30 and the electronic supporting system 30A. For this reason, motion/servo controller of the electronic supporting system 30A is labeled with 140Ab in FIG. 8.

Figure 9:
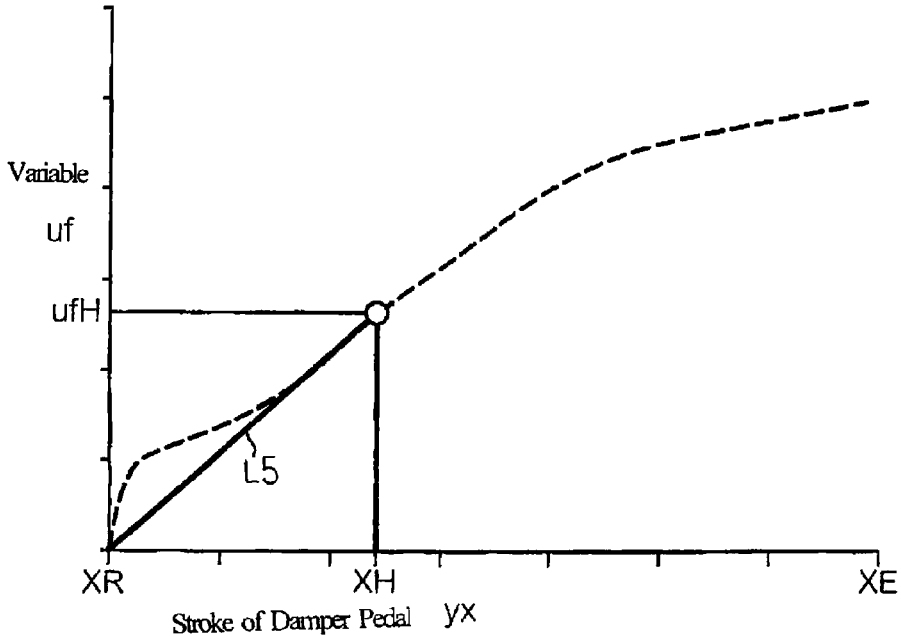
FIG. 9 is a graph showing a relation between the stroke of a damper pedal and a value of a variable used in the assistance to musician in pedaling in the automatic player piano.

Although the pedal stroke table shown in FIG. 6 is stored in the read only memory 103 of the electronic supporting system 30, any pedal stroke table is not prepared for the electronic supporting system 30A. Instead, a pedal stroke XR at the rest position, a pedal stroke XH at the entrance XH of half pedal region, a pedal stroke XE at the end position and a value ufH of variable uf are stored in the read only memory 103 of the electronic supporting system 30A. The pedal stroke XR, XH and XE and value ufH are seen in FIG. 9.

The motion/servo controller 140Ab behaves as similar to the motion/servo controller 140*b* except that the motion controller determines the value of variable uf through calculation. In detail, when the actual pedal position yx is supplied to the motion controller of motion/servo controller 140Ab, the motion controller firstly checks the actual pedal position yx to see whether or not the damper pedal 110 reaches or exceeds the entrance XH of half pedal region. If the answer is given negative, the damper pedal stroke yx is less than the damper pedal stroke at the entrance XH of half pedal region, and the damper pedal 110 is still on the way to the entrance XH of half pedal region. With the negative answer, the motion controller reads out the values of pedal stroke XR, XH and XE and the value ufH of variable uf from the read only memory 103, and calculates the value of variable uf as:

$$uf = ufH \times (yx - XR)/(XH - XR) \qquad \text{Equation 1}$$

On the contrary, if the answer is given affirmative, the motion controller determines the variable uf at zero.

From equation 1, the variable uf is linearly increased as indicated by plots L5 in FIG. 9 between the rest position XR and the entrance XH of half pedal region, and is rapidly decayed to zero at the entrance XH of half pedal region as shown in FIG. 9. Since the electronic supporting system 30A bears the part of the load on the damper pedal 110, the load borne by a human player is varied as indicated by plots L6.

Figure 10:
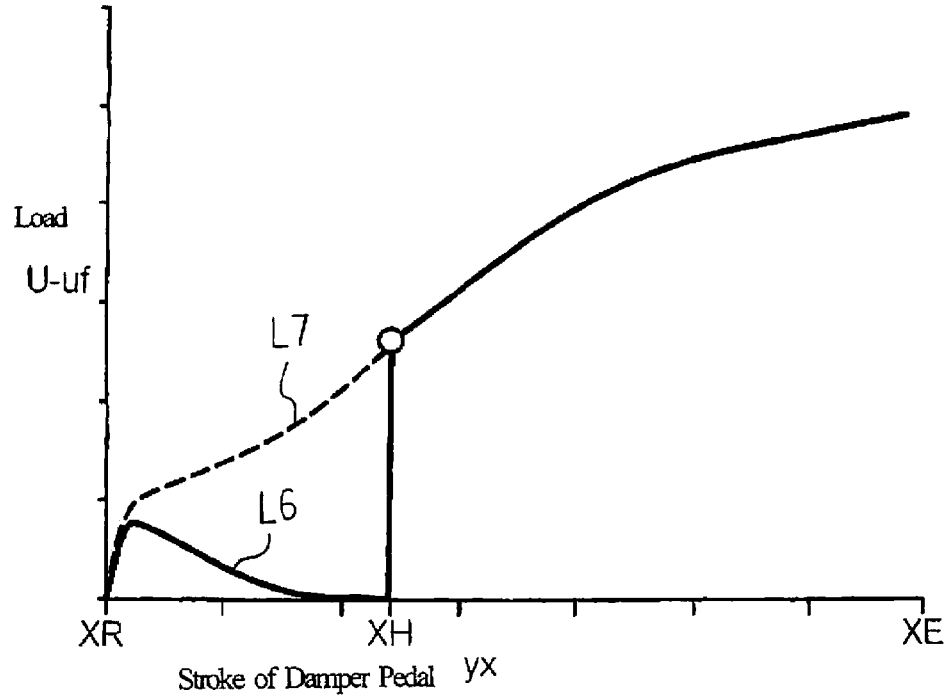
FIG. 10 is a graph showing a relation between the stroke of damper pedal and load borne by a human player.

The human player bears only a part of the load on the damper pedal 110 between the rest position XR and the entrance XH of half pedal region, and the electronic supporting system 30Aa bears the difference between broken lines L7 and the plots L6. (See FIG. 10) As a result, the human player feels the damper pedal 110 light until the entrance XH. However, the electronic supporting system 30Aa rapidly removes the assisting force from the damper pedal 110 at the entrance XH. For this reason, the human player feels the load suddenly increased at the entrance XH of half pedal region.

Thus, the human player leans the pedaling to the half pedal region with the assistance of the electronic supporting system 30Aa without averting the eyes from the music score.

Third Embodiment

Figure 11:
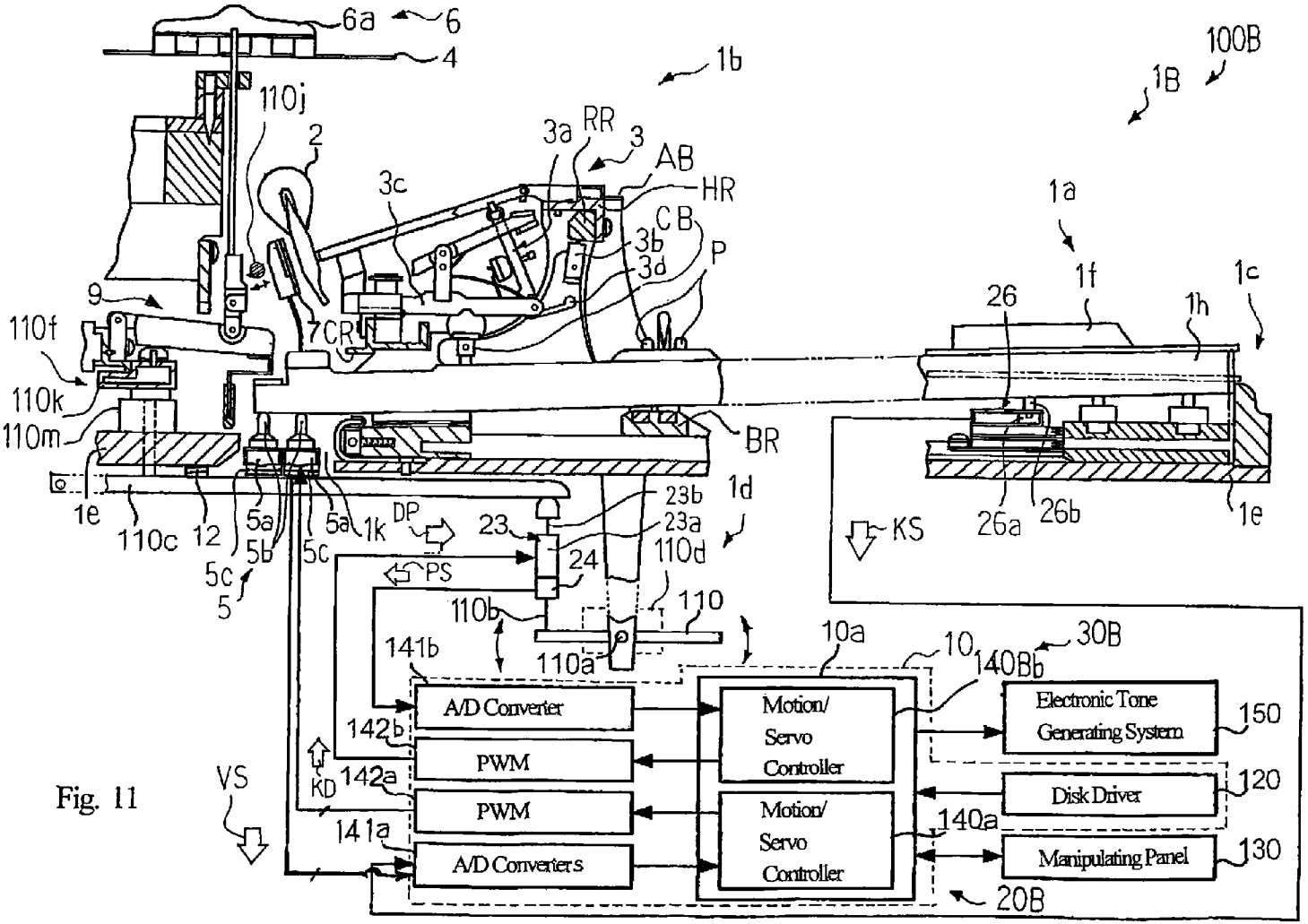
FIG. 11 is a cross sectional side view showing yet another automatic player piano of the present invention.

Turning to FIG. 11 of the drawings, yet another automatic player piano 100B embodying the present invention largely comprises a grand piano 1B, an automatic playing system 20B and an electronic supporting system 30B. The grand piano 1B and automatic playing system 20B are similar in structure and operation to the grand piano 1 and automatic playing system 20, and, for this reason, component parts of grand piano 1B and system components of automatic playing system 20B are labeled with references designating the corresponding component parts of grand piano 1 and the system components of automatic playing system 20 without detailed description for the sake of simplicity.

The system components of automatic playing system 20B are also shared with the electronic supporting system 30B. However, the subroutine program for assistance in pedaling is different between the electronic supporting system 30 and the electronic supporting system 30B. For this reason, motion/servo controller of the electronic supporting system 30B is labeled with 140Bb in FIG. 11.

Although the motion/servo controller 140*b* varies the assisting force by changing the variable uf, the motion/servo controller 140Bb varies the assisting force by changing the target pedal position rx.

In detail, Kx stands for the position gain, and ufH stands for the value of variable uf at the entrance XH. The value of variable uf at the damper pedal stroke XR is expressed as ufR. The position gain Kx, values ufH and ufR and the values XR and XH of damper pedal stroke are stored in the read only memory 103. Constants AK and BK are calculated as $$AK=(ufH-ufR)/(XH-XR)/Kx \quad \text{Equation 2}$$

$$BK=ufH/Kx \quad \text{Equation 3}$$

While the motion/servo controller 140Bb is operating in the assist mode, a human player is assumed to start to depress the damper pedal 110. The actual pedal position yx is periodically increased. When the actual pedal position yx arrives at the motion controller of motion/servo controller 140Bb, the motion controller compares the actual pedal position yx with the entrance XH to see whether or not the damper pedal 110 reaches or exceeds the entrance XH.

If the answer is given negative, the motion controller calculates the target pedal position rx as $$rx=AK\times yx+BK+yx \quad \text{Equation 4}$$

When the target pedal position rx is calculated, the motion controller subtracts the actual pedal position yx from the target pedal position rx so as to determine the position difference. From equation 4, the target pedal position is larger in value than the actual pedal position yx so that the product ux is greater than zero. On the other hand, the motion controller fixes the variable uf to zero. The product ux is added to the variable uf, and the target amount of mean current is determined as the sum of the product ux and variable uf. Although the variable uf is zero, the product ux is greater than zero, and, accordingly, the sum u is also greater than zero. The pulse width modulator 142*b* adjusts the driving signal DP to the duty ratio ui equivalent to the target amount of mean current. For this reason, the solenoid-operated pedal actuator 23 exerts the assisting force on the damper pedal 110.

When the answer is given affirmative, the damper pedal 110 reaches or exceeds the entrance XH. The motion controller makes the target pedal position rx equal to the actual pedal position yx, and still keeps the variable uf zero.

Figure 12:
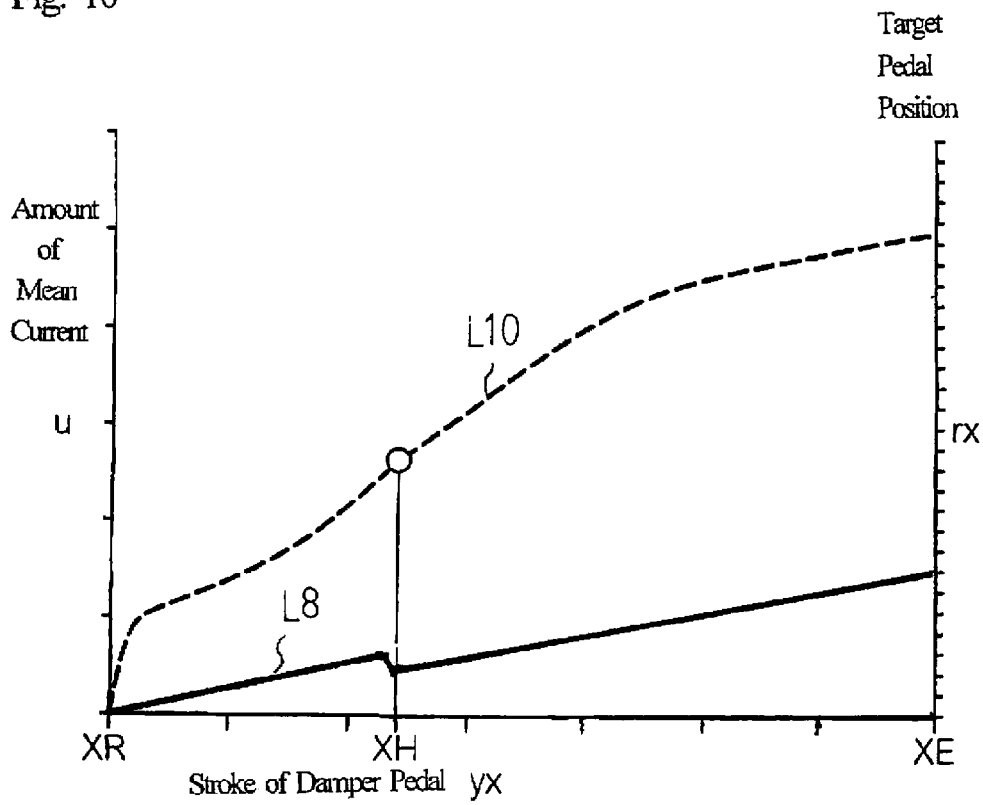
FIG. 12 is a graph showing a relation between a target pedal position and an actual pedal position in the assistance in pedaling in the automatic player piano.

The target pedal position rx is varied as indicated by plots L8 in FIG. 12. For this reason, the positional difference and, accordingly, the product ux become equal to zero, and the sum of the product ux and variable uf becomes equal to zero.

Figure 13:
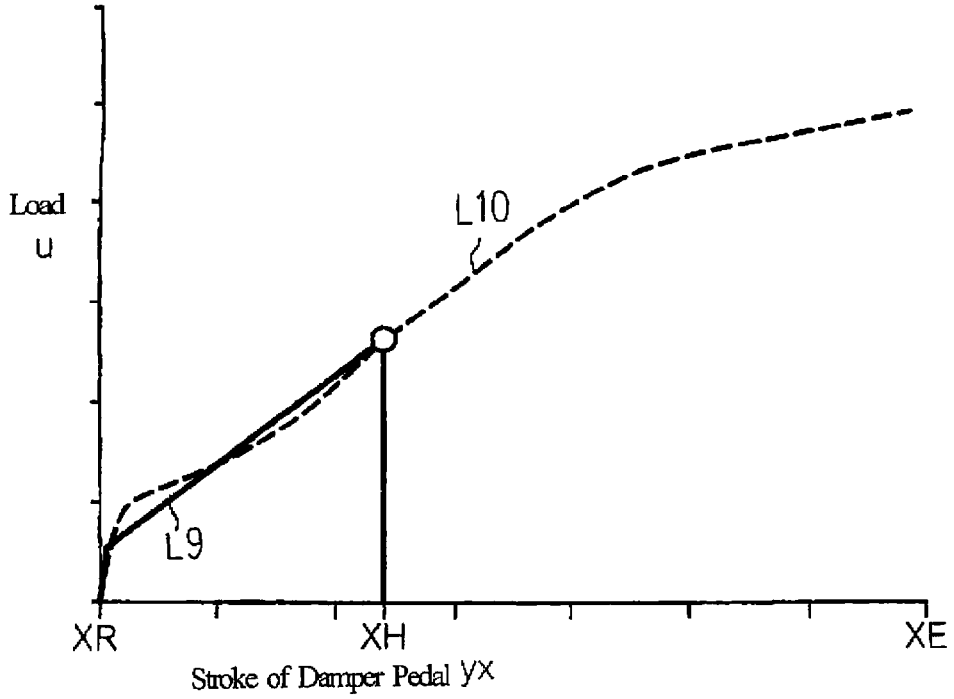
FIG. 13 is a graph showing a relation between the stroke of damper pedal and the assisting force.

Thus, the target amount of mean current u is increased from the rest position XR to the entrance XH of half pedal region so as to exert the assisting force on the damper pedal 110. However, the target amount of mean current u is rapidly reduced to zero at the entrance XH as indicated by plots L9 in FIG. 13. As a result, any assisting force is not exerted on the damper pedal 110. Plots L10 is indicative of the amount of mean current u for driving the damper pedal 110 in the automatic performance in FIGS. 12 and 13.

Figure 14:
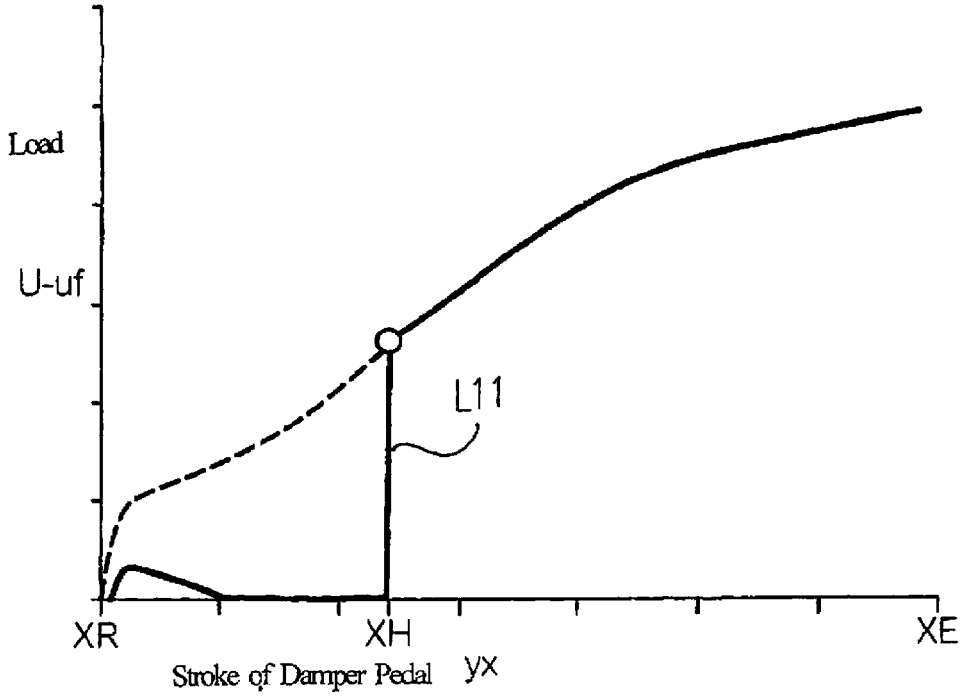
FIG. 14 is a graph showing a relation between the stroke of damper pedal and load borne by a human player.

As described hereinbefore, the electronic supporting system 30B exerts the assisting force between the rest XR position and the entrance XH of half pedal region so that the load U-uf borne by the human player is small until the entrance XH of half pedal region as indicated by plots L11 in FIG. 14. The load U-uf is rapidly increased at the entrance XH. Thus, the human player can learn the stroke of damper pedal 110 to the half pedal region with the assistance of the electronic supporting system 30B. In other words, the electronic supporting system 30B achieves all the advantages of the electronic supporting system 30.

Fourth Embodiment

Figure 15:
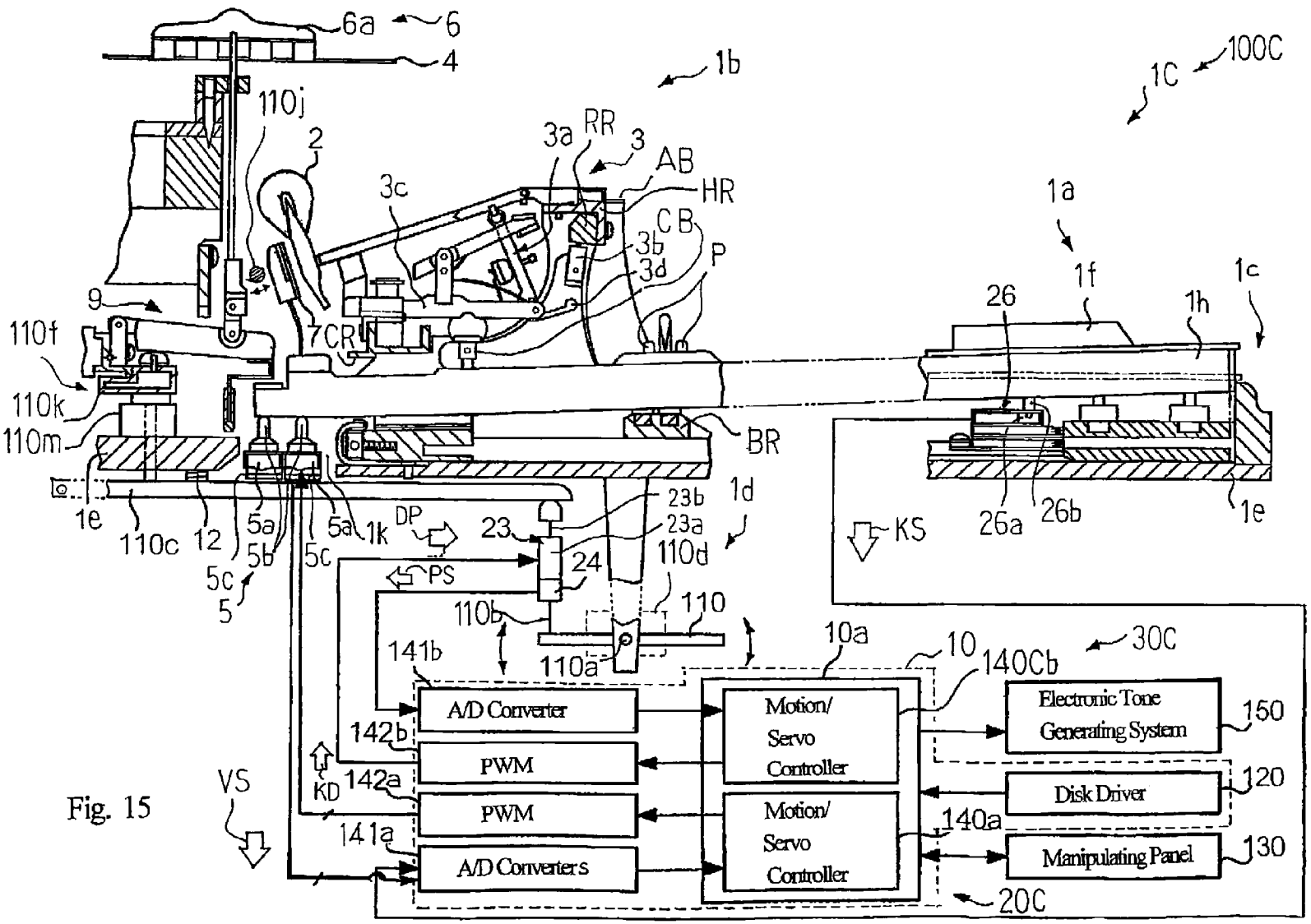
FIG. 15 is a cross sectional side view showing still another automatic player piano of the present invention.

Turning to FIG. 15 of the drawings, still another automatic player piano 100C largely comprises a grand piano 1C, an automatic playing system 20C and an electronic supporting system 30C. The grand piano 1C and automatic playing system 20C are similar in structure and operation to the grand piano 1 and automatic playing system 20, and, for this reason, component parts of grand piano 1C and system components of automatic playing system 20C are labeled with references designating the corresponding component parts of grand piano 1 and the system components of automatic playing system 20 without detailed description for the sake of simplicity.

The system components of automatic playing system 20C are also shared with the electronic supporting system 30C. However, the subroutine program for assistance in pedaling is different between the electronic supporting system 30 and the electronic supporting system 30C. For this reason, motion/servo controller of the electronic supporting system 30C is labeled with 140Cb in FIG. 14.

Although the electronic supporting systems 30, 30A and 30B make the load borne by the human players light until the entrance XH of half pedal region, the electronic supporting system 30C exerts the assisting force on the damper pedal 110 in a manner opposite to the electronic supporting systems 30, 30A and 30B. In detail, the electronic supporting system 30C exerts the electromagnetic force on the damper pedal 110 in the half pedal region. However, a human player needs to move the damper pedal 110 by only his or her foot force outside the half pedal region.

Figures 16, 17:
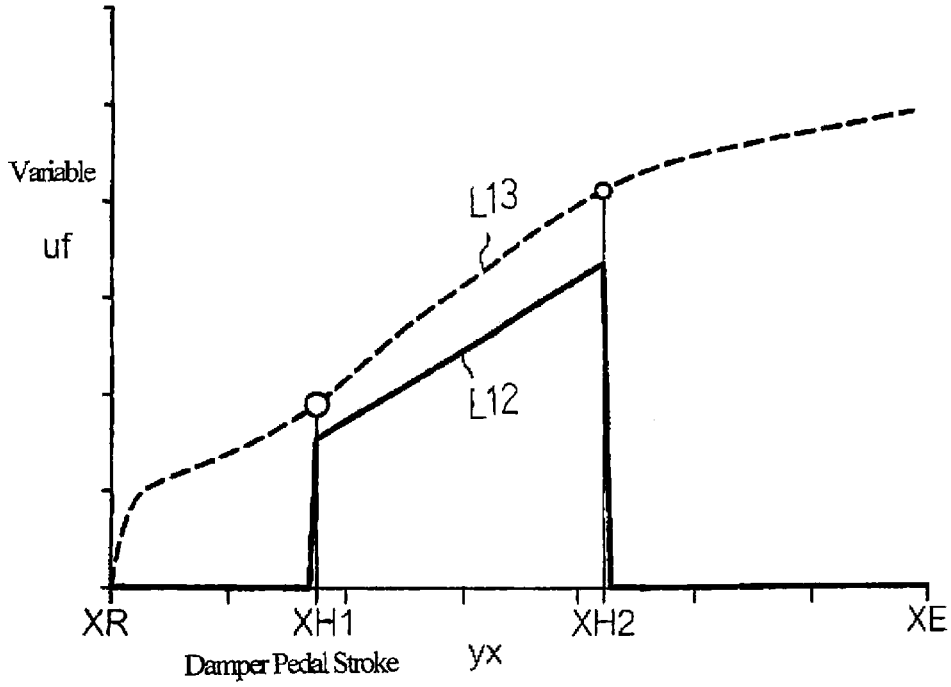
FIG. 16 is a view showing contents of a pedal stroke data table.
FIG. 17 is a graph showing a relation between the values of a variable and the actual pedal stroke.

In detail, a pedal stroke table, contents of which are shown in FIG. 16, is defined in the read only memory 103. The variable uf is zero until the entrance XH1 of half pedal region, and has finite values UF1, uf11, uf12, . . . and UF2 between the entrance XH1 and an exit XH2 of the half pedal region. The variable uf is rapidly decreased to zero upon exit from the half pedal region.

In operation, the motion/servo controller 140Cb behaves as similar to the motion/servo controller 140*b* in the automatic performance and non-assist mode. When a human player selects the assistance in pedaling, the assist flag is raised, and the main routine program periodically branches to a subroutine program for the assistance in pedaling.

While the central processing unit 102 is reiterating the subroutine program for assistance, the motion/servo controller 140Cb is realized as follows.

The latest piece of pedal position data is read out from the data table, and is normalized through the software bock 154, and the normalized piece of pedal position data is stored in the pedal position data code through the software block 155. The pedal position data code is supplied to both of the motion controller and the comparator 151. The motion controller makes the target pedal position rx equal to the latest actual pedal position yx, and the target pedal position rx is compared with the actual pedal position yx. The position difference is not found between the target pedal position rx and the actual pedal position yx, i.e., the position difference is zero. The position difference is multiplied with the position gain. However, the product is zero.

The motion controller accesses the pedal position data table, and reads out the value of variable uf from the pedal position data table. While the damper pedal 110 is traveling on the way to the entrance XH, the variable uf is zero. The sum of product ux and variable uf is zero so that the pulse width modulator 142*b* keeps the duty ratio ui of driving signal DP at zero. As a result, an electromagnetic force is not exerted on the damper pedal 110. The human player depresses the damper pedal 110 by only his or her foot force, and feels the damper pedal 110 heavy.

When the damper pedal 110 reaches the entrance XH1 of half pedal region, the variable uf is changed to UF1 as indicated by plots L12 in FIG. 17. Although the product ux is still zero, the sum u of product ux and variable uf is equal to the value UF1. The pulse width modulator 142*b* adjusts the driving signal DP to a duty ratio ui equivalent to the sum UF1 so that the solenoid-operated pedal actuator 23 exerts the assisting force on the damper pedal 110. The human player feels the damper pedal 110 suddenly changed light. Thus, the human player notices the damper pedal 110 entering the half pedal region.

While the damper pedal 110 is traveling in the half pedal region, the motion/servo controller 140Cb keeps the damper pedal 110 light by virtue of the assisting force. When the damper pedal 110 reaches the actual pedal position yx21, the damper pedal 110 exceeds the half pedal region, and the motion controller rapidly reduces the variable uf to zero. The sum of product ux and variable uf also becomes zero so that any assisting force is not exerted on the damper pedal 110. The human player feels the damper pedal 110 heavy, again, and notices the damper pedal 110 exceeding the half pedal region.

While the human player is performing in the assist mode, the above-described control sequence is periodically repeated. The variable uf is varied as indicated by plots L12 in FIG. 17. While the motion/servo controller 140Cb is operating in the automatic performance, the electromagnetic force is exerted on the damper pedal 110 as indicated by plots L13, and the difference between plots L12 and plots L13 is borne by the human player. The human player can learn both of the entrance XH1 and exit XH2 with the assistance of electronic supporting system 30C.

Although the motion/servo controller 140Cb reads out the variable uf from the pedal stroke table, a modification of the motion/servo controller 140Cb calculates the value of variable uf in the half pedal region as follows.

$$uf=((UH2-UH1)\times(yx-XH1)/(XH2-XH1)+UH)\times Su \qquad \text{Equation 5}$$

where XH1 and XH2 are same as those in FIG. 17, UH1 is a value of variable uf for moving the damper pedal 110 to the entrance XH1 by only the electromagnetic force, UH2 is a value of variable uf for moving the damper pedal 110 to the exit XH2 by only the electromagnetic force and Su is a coefficient.

Fifth Embodiment

Figure 18:
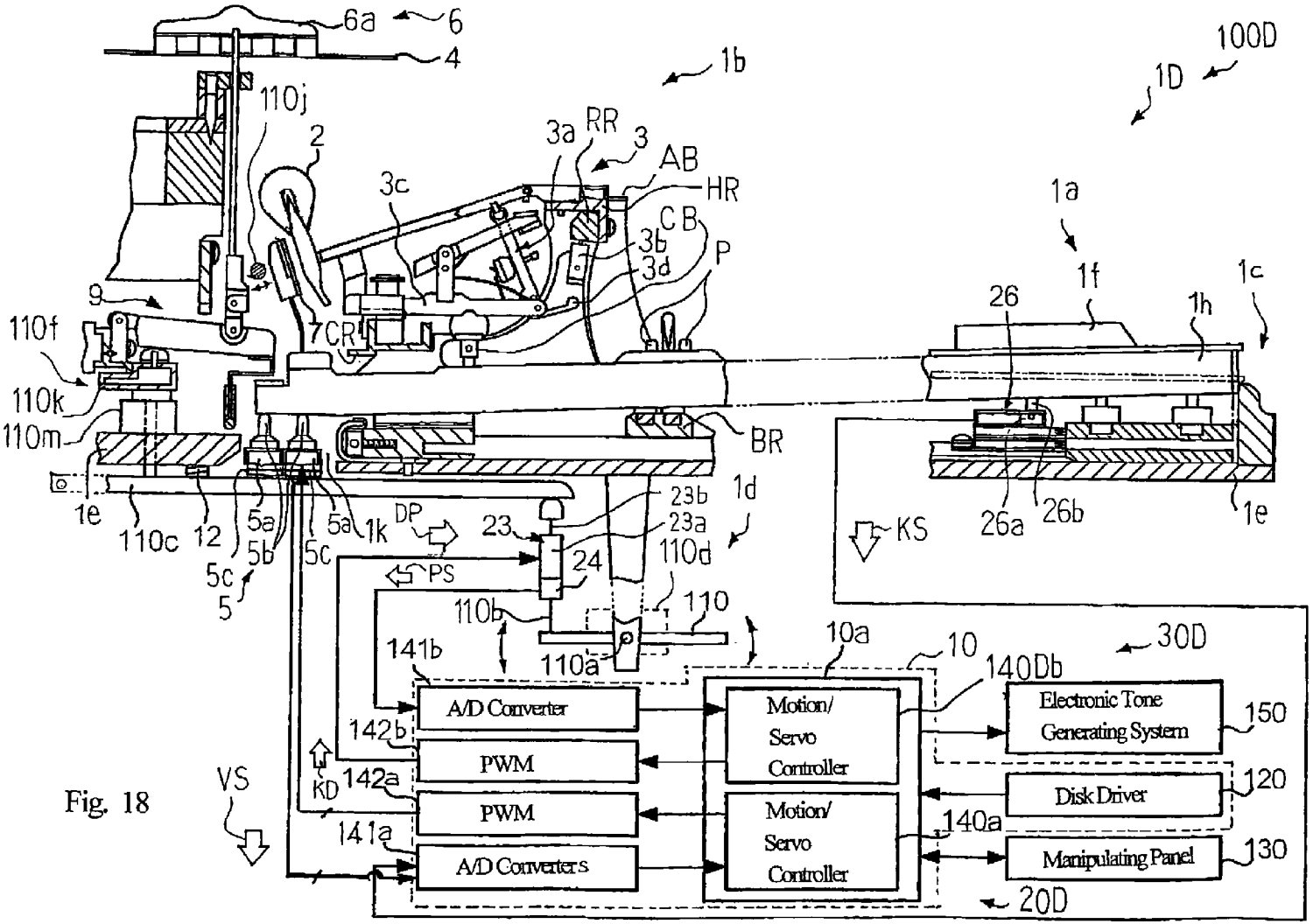
FIG. 18 is a cross sectional side view showing yet another automatic player piano of the present invention.

Turning to FIG. 18 of the drawings, yet another automatic player piano 100D largely comprises a grand piano 1D, an automatic playing system 20D and an electronic supporting system 30D. The grand piano 1D and automatic playing system 20D are similar in structure and operation to the grand piano 1 and automatic playing system 20, and, for this reason, component parts of grand piano 1D and system components of automatic playing system 20D are labeled with references designating the corresponding component parts of grand piano 1 and the system components of automatic playing system 20 without detailed description for the sake of simplicity.

The system components of automatic playing system 20D are also shared with the electronic supporting system 30D. However, the subroutine program for assistance in pedaling is different between the electronic supporting system 30 and the electronic supporting system 30D. For this reason, motion/servo controller of the electronic supporting system 30D is labeled with 140Db in FIG. 18.

Figure 19:
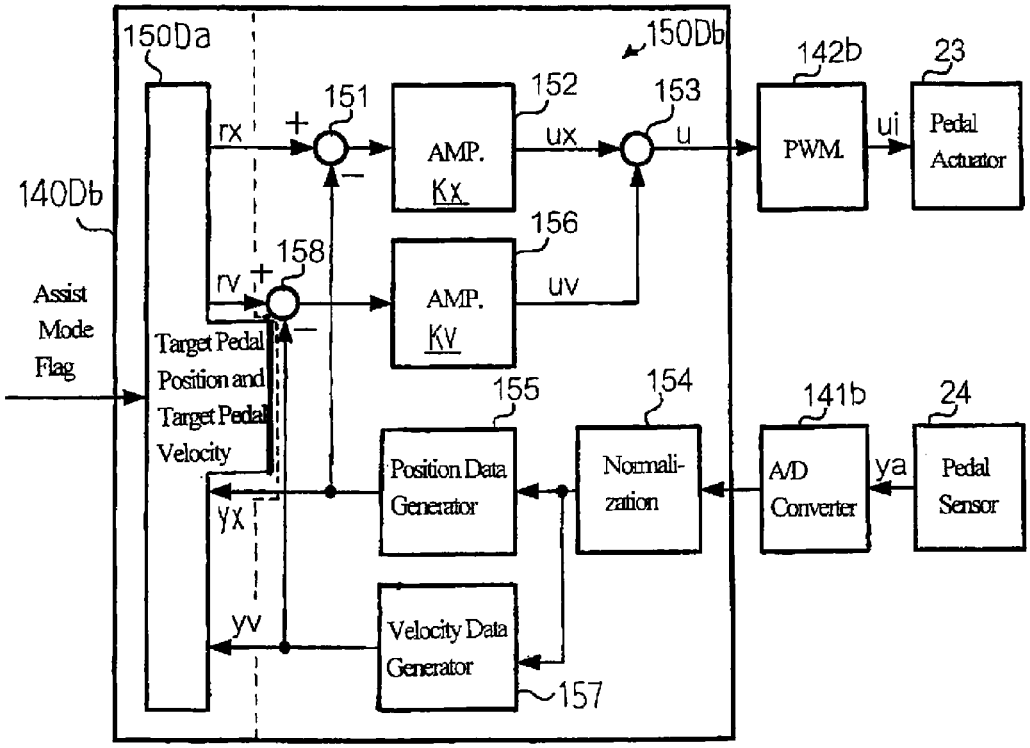
FIG. 19 is a block diagram showing the software modules of a motion/servo controller incorporated in the automatic player piano.

Although the motion/servo controller 140*b* achieves the servo control on the damper pedal 110 through the comparison between the target pedal position yx and actual pedal position rx, the motion/servo controller 140Db controls the damper pedal 110 on the basis of not only the comparison between the target pedal position rx and the actual pedal position yx but also comparison between a target pedal velocity rv and an actual pedal velocity yv as shown in FIG. 19 in both of the automatic performance and assistance in pedaling.

FIG. 19 shows software blocks of the motion/servo controller 140Db. The motion/servo controller 140Db is broken down into a motion controller 150Da and a servo controller 150Db. Comparing the software blocks shown in FIG. 19 with the software blocks shown in FIG. 4, it is understood that software blocks 156, 157 and 158 are newly added to the servo controller 150*b*. The motion controller 150Da not only reads out the target pedal position rx from the pedal stroke data table but also determines a target pedal velocity rv.

A series of pieces of normalized actual pedal position data yx is differentiated through the software module 157, and a piece of actual pedal velocity data yv is stored in a pedal velocity data code. The piece of actual pedal velocity data yv is supplied to the motion controller 150Da and the software module 158. The motion controller 150Da supplies a target pedal velocity rv to the software module 158, and a velocity difference between the target pedal velocity rv and the actual pedal velocity yv is determined through the software module 158, and the velocity difference is multiplied by a velocity gain Kv. The product uv is added to the product ux, and the sum u of products ux and uv is supplied to the pulse width modulator 142 as a piece of data expressing the target amount of mean current. Thus, the target amount of mean current u is given as $$u=ux+uv=Kx\times(rx-yx)+Kv\times(rv-yv) \quad \text{Equation 6}$$

While the damper pedal 110 is traveling in one of the half pedal region or outside of the half pedal region, the electronic supporting system 30D exerts the assisting force on the damper pedal 110, and does not exert any assisting force on the damper pedal 110 in the other of the half pedal region and outside of the half pedal region. The motion controller 150Da determines the target pedal position rx and target pedal velocity rv as follows.

While the electronic supporting system 30D is not exerting the assisting force on the damper pedal 110, the motion controller 150Da adjusts the target pedal position rx and target pedal velocity rv to the value of actual pedal position yx and the value of actual pedal velocity yv, respectively. As a result, the addition between the products ux and uv results in zero. Any assisting force is not generated through the solenoid-operated pedal actuator 23.

On the other hand, while the electronic supporting system 30D is exerting the assisting force on the damper pedal 110, the motion controller 150Da adjusts the target pedal velocity rv to zero at all times. The difference has a negative value, and the product uv also has a negative value. On the other hand, the motion controller 150Da adjusts the target pedal position to a positive value greater than the value of actual pedal position, and the product ux has a positive value. The positive value of target pedal position rx is selected in such a manner that the absolute value of product ux is greater than the absolute value of product uv. For this reason, the sum u of products ux and uv is given as a small positive value, and the solenoid-operated pedal actuator 23 exerts the weak assisting force on the damper pedal 110. If the human player exerts large foot force on the damper pedal 110, the damper pedal 110 is rapidly depressed. However, the large actual pedal velocity yv makes the sum u of products ux and uv have a small value. Accordingly, the assisting force is decreased. The target pedal velocity may be a fixed value Yv.

As will be understood from the foregoing description, the electronic supporting system 30D exerts the assisting force on the damper pedal 110 in one of the half pedal region and outside of half pedal region, and removes the assisting force from the damper pedal 110 in the other of the half pedal region and outside of half pedal region. The human player notices the damper pedal 110 changed in load. Thus, the human player can learn the appropriate pedal stroke to the half pedal region with the assistance of the electronic supporting system 30D.

Sixth Embodiment

Figure 20:
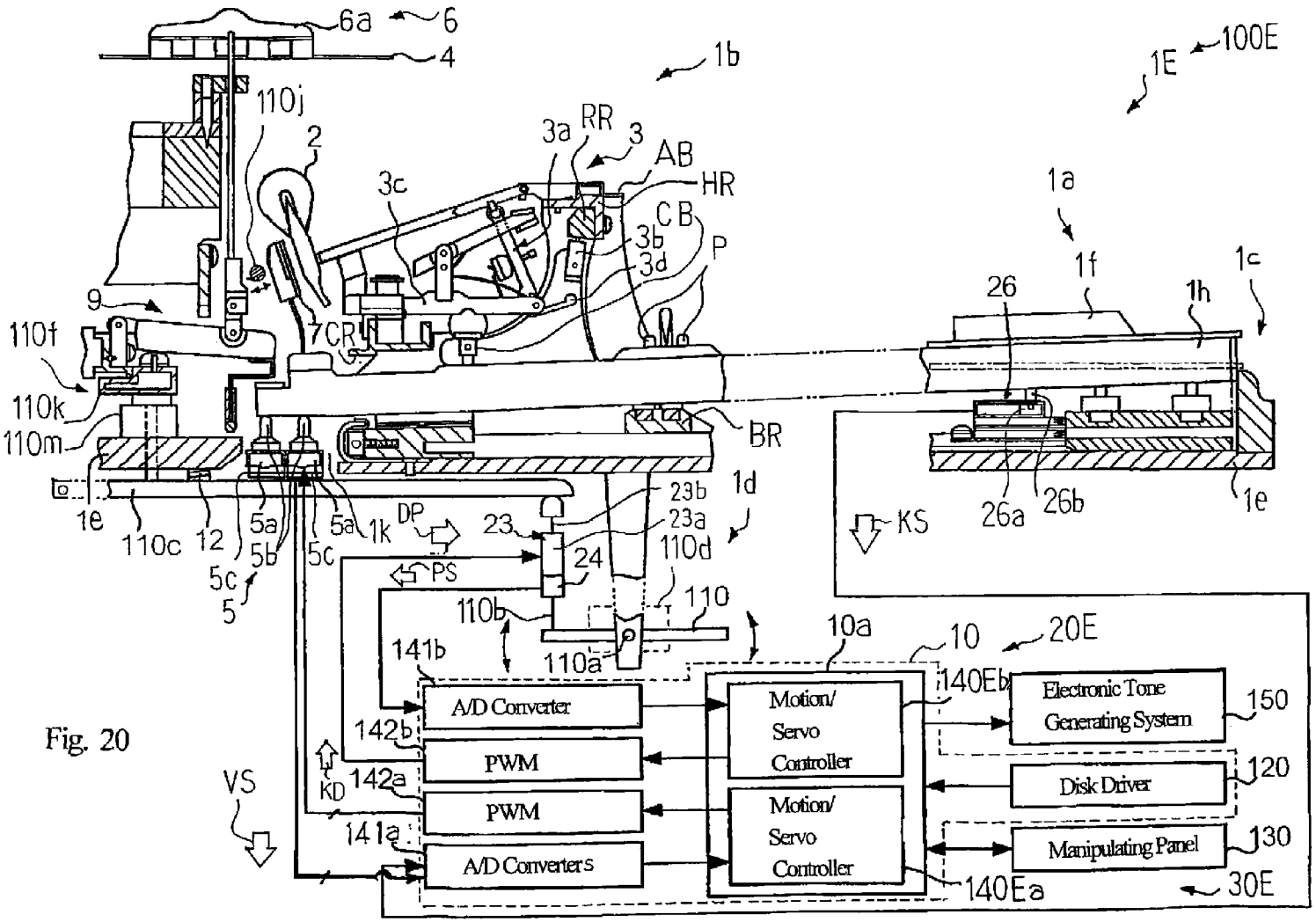
FIG. 20 is a cross sectional side view showing still another automatic player piano of the present invention.

Turning to FIG. 20 of the drawings, still another automatic player piano embodying the present invention largely comprises a grand piano 1E, an automatic playing system 20E and an electronic supporting system 30E. The grand piano 1E and automatic playing system 20E are similar in structure and operation to the grand piano 1 and automatic playing system 20, and, for this reason, component parts of grand piano 1E and system components of automatic playing system 20E are labeled with references designating the corresponding component parts of grand piano 1 and the system components of automatic playing system 20 without detailed description for the sake of simplicity.

The system components of automatic playing system 20E are also shared with the electronic supporting system 30E. However, the electronic supporting system 30E is adapted to make human players to lean the key stroke to the let-off. For this reason, the electronic supporting system 30E includes the solenoid-operated key actuators 5, key sensors 26, analog-to-digital converters 141*a* and pulse width modulators 142*a* instead of the damper pedal 23, damper position sensor 24, analog-to-digital converter 141*b* and pulse width modulator 142*a*, and a subroutine program for assistance in fingering forms a part of the computer program. The subroutine program for assistance in pedaling is not incorporated in the computer program. For this reason, motion/servo controllers of the electronic supporting system 30E are labeled with 140Ea and 140Eb in FIG. 20.

The damper, sostenuto and soft pedals 110, 11 and 112 are controlled through the motion/servo controller 140Eb in the automatic performance. However, the motion/servo controller 140Eb stands idle in the assistance to musician in fingering. The software modules of motion/servo controller 140Ea is active in both of the automatic performance and assistance in fingering, and software modules of the motion/servo controller 140Ea are similar to those of the motion/servo controller 140Db shown in FIG. 19. For this reason, the software modulates of motion/servo controller 140Db are hereinafter labeled with the references designating the corresponding software modules of the motion/servo controller 140Db, and rx, rv, yx and yv stand for a target key position, a target key velocity, an actual key position and an actual key velocity, respectively.

While a human player is performing a music tune on the grand piano 1E without any assistance in fingering, the motion controller 150Da adjusts the target key position rx and target key velocity yv to the value of actual key position yx and the value of actual key velocity so that the pulse width modulator 142 keeps the duty ratio of driving signals DK at zero. For this reason, the solenoid-operated key actuators 5 keeps the plungers 5*b* at the original positions. Thus, any assisting force is not exerted on the keys 1*f* and 1*h*.

When the human player requests the electronic supporting system to guide his or her fingers to the let-off points of keys 1*f* and 1*h*, the assist mode flag is raised, and the main routine program starts periodically branch to the subroutine program for assistance. Assuming now that the human player depresses one of the keys 1*f* or 1*h*, the associated key sensor 26 reports the departure from the rest position, and the motion/servo controller 140Db starts to make the human player notice the let-off point.

While the key 1*f* or 1*h* is traveling from the rest position to a certain key position close to the let-off point, the motion controller 150Da keeps the target key velocity rv at zero, and the target key position rx larger than the actual key position yx. The target amount of mean current u has a small value, and the pulse width modulator 142*a* adjusts the duty ratio of driving signal DK to a small value equivalent to the small amount of mean current. As a result, the assisting force is exerted on the key 1*f* or 1*h*, and the human player feels the key 1*f* or 1*h* light.

When the key 1*f* or 1*h* reaches a certain point close to the let-off point, the motion controller 150Da adjusts the target key position rx and target key velocity rv to the value of actual key position yx and the value of actual key velocity yv. As a result, the assisting force is reduced to zero, and the human player suddenly feels the key 1*f* or 1*h* heavy.

When the key 1*f* or 1*h* reaches the let-off point, the jack 3*a* lets the hammer assembly 2 escape from the jack 3*a*, and the load on the key 1*f* or 1*h* is reduced. The human player feels the key 1*f* or 1*h* light, again. Thus, the electronic supporting system 30E makes the human player learn the key stroke at the let-off by varying the load borne by the human player.

Seventh Embodiment

Figure 21:
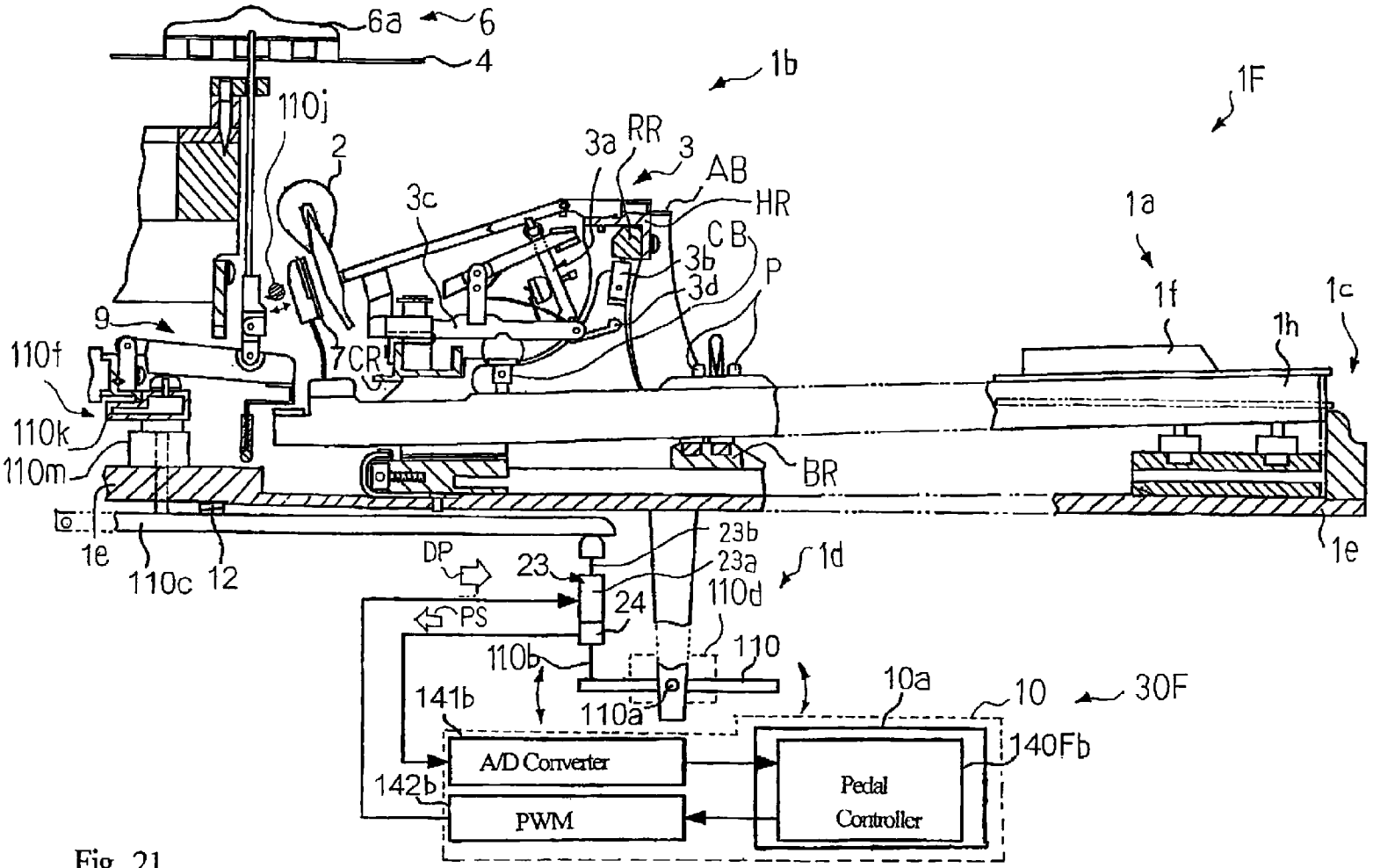
FIG. 21 is a cross sectional side view showing a grand piano equipped with the supporting system of the present invention.

Turning to FIG. 21 of the drawings, a grand piano 1F is equipped with an electronic supporting system 30F in accordance with the present invention. However, any automatic playing system is not installed in the grand piano 1F. The grand piano 1F is similar in structure and behavior to the grand piano 1. For this reason, component parts of grand piano 1F are labeled with references designating the corresponding component parts of grand piano 1 without detailed description.

The electronic supporting system 30F is adapted to make a human player learn the pedal stroke to a half pedal region, and includes a controller, a solenoid-operated pedal actuator and a pedal sensor. System components of the controller, solenoid-operated pedal actuator and pedal sensor are similar in structure and roles to those of the electronic supporting system 30. For this reason, the system components of controller, solenoid-operated pedal actuator and pedal sensor are labeled with references designating corresponding system components of the electronic supporting system 30.

A computer program runs on the information processing system 10*a*, and is same as the computer program installed in the information processing system 10*a* of the automatic player piano 100 except for the subroutine program for automatic performance. Since any automatic playing system is not provided for the grand piano 1F, the subroutine program for the automatic performance does not form any part of the computer program installed in the electronic supporting system 30F. Accordingly, the motion/servo controller is only responsive to the request for assistance in pedaling. For this reason, a pedal controller 140Fb is realized through the execution of the subroutine program for assistance.

While the damper pedal 110 is traveling from the rest position to the entrance of half pedal region, the pedal controller 140Fb makes the solenoid-operated pedal actuator 23 exert the assisting force on the damper pedal 110, and the human player feels the damper pedal 110 light. However, when the damper pedal 110 reaches the entrance of half pedal region, the pedal controller 140Fb makes the solenoid-operated pedal actuator 23 remove the assisting force from the damper pedal 110 at the entrance of the half pedal region 110. Thus, the human player can learn the pedal stroke to the half pedal region with the assistance of electronic supporting system 30F.

Although particular embodiments of the present invention have been shown and described, it will be apparent to those skilled in the art that various changes and modifications may be made without departing from the spirit and scope of the present invention.

The automatic player piano may be equipped with a mute system. The mute system has a hammer stopper and a change-over mechanism for changing the hammer stopper between a blocking position and a free position. The hammer stopper is provided in a space between the hammers at the rest positions and the strings. While the hammer stopper is staying in the free position, the hammers are brought into collision with the strings, and gives rise to the vibrations of strings. However, when the hammer stopper is changed to the blocking position, the hammers rebound on the hammer stopper before reaching the strings. For this reason, any acoustic tone is not generated on the condition that the hammer stopper stays at the blocking position. Instead, the electronic tone generating system generates the electronic tones through analysis on the pieces of actual key positions, and the human player hears the electronic tones through a headphone. Thus, the mute system prevents the neighborhood from the piano tones. When the human player depresses the pedals, the movements of pedals are reported from the pedal sensors to the information processing system, and the information processing system makes the electronic tone generator impart the effects to the electronic tones. Although the electronic tones and effects to be imparted to the electronic tones are generated on the basis of the analysis on the pieces of key position data and the pieces of pedal position data, and, for this reason, the timing to generate the electronic tones and the timing to impart the effects may be slightly different from those of the acoustic tones. In this situation, a user and a tuner appreciate the electronic supporting system for assistance in pedaling, because the electronic supporting system specifies the entrance of half pedal region by changing the load borne by the user and tuner. The user or tuner can easily adjust the pedal sensor to an optimum position through the comparison between the entrance of half pedal region specified by the electronic supporting system and an actual changing point of electronic tones.

A recording system may be further provided for the automatic player piano. In this instance, the electronic supporting system guides the human player to the entrance of half pedal region so that the user can record a good performance through the recording system.

The electronic supporting system of the present invention may be provided in another sort of keyboard musical instrument such as, for example, a mute piano or a keyboard for practice. Moreover, the electronic supporting system may be provided for an electronic keyboard in so far as the electronic key board has a pedal, which imparts different effects to electronic tones depending upon the pedal stroke. Furthermore, an organ or a percussion instrument may be equipped with the electronic supporting system of the present invention.

The MIDI protocols do not set any limit to the automatic performance. Other sorts of music data protocols had been proposed before the MIDI protocols, and another sort of music data protocols has been proposed after the MIDI protocols. Even if the music data codes are prepared in accordance with one of the other sorts of music protocols, those music data codes are available for the automatic performance.

The combination of photo coupler and optical modulator does not set any limit to the key sensors 26 and pedal sensors 24. A variable resister may be connected to the key 1*f* or 1*h*. In this instance, the key 1*f* or 1*h* or plunger 23*b* is connected to a slider of the variable resistor for converting the current position to the amount of current.

Similarly, the combination of piece of permanent magnet and coil does not set any limit to the built-in plunger sensor 5*c*. A Hall-effect device may be used as a part of the velocity sensor.

The solenoid-operated actuator does not set any limit to the key actuators 5 and pedal actuators 23. A torque motor, a pneumatic actuator or electroactive polymer may be used as the key actuators 5 and/or pedal actuators 23.

The key position sensors 26, plunger velocity sensors 5*c* and pedal position sensors 24 may be replaced with another sort of key sensors, another sort of plunger sensors and another sort of pedal sensors. These other sorts of sensors may produce detecting signals representative of other sorts of physical quantity such as, for example, key velocity/key acceleration, plunger position/plunger acceleration and pedal velocity/pedal acceleration. Sensors for other sorts of physical quantity are also available for the automatic playing system 20 and electronic supporting system 30 as long as the other sorts of physical quantity express the movements of keys 1*f*/1*h* and movements of pedals 110/111/112.

The entrance XH of the half pedal region, i.e., the boundary between the non-effective region and the half pedal region does not set any limit to the technical scope of the present invention. The assisting force may be reduced to zero or a small value at a certain point in the half pedal region. The certain point is spaced from the boundary between the non-effective region and the half pedal region and further from the boundary between the half pedal region and the effective region. Otherwise, the electronic supporting system 30 may stop to bear part of load at a predetermined actual pedal position immediately before the boundary between the non-effective region and the half pedal region. The damper pedal 110 at the predetermined actual pedal position is still in the non-effective region.

In the first embodiment, the plunger of solenoid-operated pedal actuator 23 is rapidly retracted for removing the assisting force from the damper pedal 110. However, the plunger may be maintained at the entrance XH. In this instance, the human player needs to increase the foot force in order to further depress the damper pedal 110 so that the electronic supporting system 30 makes the human player taught through the increase of foot force.

The motion/servo controller 140*b* may be active in the non-assist mode of operation. In this instance, the motion controller 150*a* keeps the target pedal position rx zero regardless of the damper pedal position yx. The amount of mean current u is always zero so that any assisting force is not exerted on the damper pedal 110.

A part of or all of the software modules in the motion/servo controllers may be replaced with a wired logic circuit. For example, the software modules 151 and 158 may be replaced with comparators, the software module 153 may be replaced with an adder, and the software module 152 and 156 may be replaced with multipliers.

The electronic supporting systems 30 to 30D may give assisting force on the damper pedal 110 during the automatic performance. In case where a human player performs a piano duo on a single acoustic piano together with the automatic playing system 20 to 20D, the electronic supporting system 30 to 30D guides the human player to the proper half pedal region.

The damper pedal 110 does not set any limit to the technical scope of the present invention. The present invention is applicable to any pedal which imparts two sorts of effects to the tones depending upon the pedal stroke. Senior musicians change the stroke of soft pedal for imparting difference effects to the acoustic tones so that the present invention is applicable to the soft pedal.

In detail, while the soft pedal is staying at the rest position, the hammer 2 is usually brought into collision with the three wires of the string 4. While a human player is depressing the soft pedal 112 from the rest position to a certain pedal position SH1, the keyboard 1*a* does not start the lateral movement, and each hammer 2 is still opposed to the three wires. The hammers 2 are frequently brought into collision with the three wires so that the three wires make the three lines of hammer felt hard. If the human player further depresses the soft pedal 112 to a pedal position SH2, the keyboard completes the lateral movement, and each hammer is opposed to two wires. In this situation, when the hammers 2 are brought into collision with the strings 4, only two wires are struck with the hammers 2, and the acoustic tones are generated at small loudness. If the human player depresses the soft pedal to a certain pedal position between the pedal positions SH1 and SH2, each hammer 2 is still opposed to the three wires. However, the three lines are offset from the three wires, and another portion of hammer felt, which is still soft, is opposed to the three wires. In this situation, when the hammer 2 is brought into collision with the three wires, the acoustic tones are gentler than the acoustic tones produced through the collision between the three lines and the three wires. In other words, the quality of tones is changed depending upon the stroke of soft pedal 112. Thus, the human player can impart the different two effects to the acoustic tones by depressing the soft pedal 112 to one of the two pedal positions.

In order to make a human player learn the pedal stroke to the certain pedal position, an electronic supporting system of the present invention exerts the assisting force on the soft pedal until the pedal position SH1 or a pedal position slightly over the pedal position SH1, and suddenly removes the assisting force from the soft pedal at the pedal position SH1 or the pedal position. The human player can notice the soft pedal entering the region where the acoustic tones become gentle.

Even if a human player changes the soft pedal between two regions, i.e., non-effective region and effective region, the human player may appreciate the electronic supporting system, which guides the soft pedal to the boundary between the non-effective region and the effective region, because the human player wishes quickly to change the soft pedal in the vicinity of the boundary.

An electronic supporting system of the present invention may make a human player learn not only the pedal stroke to the half-pedal region but also the key stroke to the let-off points. In this instance, the computer program has both of the subroutine programs described in conjunction with the first to fifth embodiments and sixth embodiment.

The electronic supporting system 30F may be built in the grand piano 1F, or is retrofitted to the grand piano 1F. The electronic supporting systems 30 to 30F may be offered to users as a portable system.

The motion/servo controller 140Ea may change the load to be borne by a human player at the let-off points.

Claim languages are correlated with the component parts of first to seventh embodiments as follows. The automatic player piano 100, 110A, 100B, 100C, 100D or 100E or grand piano 1F serves as "a musical instrument". The damper pedal 110, soft pedal 112 or keys 1*f* and 1*h* serve as "at least one manipulator", and the rest position, end position and reference assisting trajectory are respectively corresponding to "a rest position", "an end position" and "a track".

The solenoid-operated pedal actuator 23 or solenoid-operated key actuators 5 serve as "an actuator", and the driving signal DP or DK is corresponding to "a driving signal". The pedal position sensor 24 or key position sensor 26 serves as "a sensor", and the actual pedal position or actual key position is corresponding to "an actual physical quantity." The pedal position signal PS or key position signal KS is corresponding to "a detecting signal".

The controller 10 is corresponding to "a controller". The entrance XH or XH1 of half pedal region, exit XH2 from the half pedal region, certain pedal position between the pedal strokes SH1 and SH2 or certain key position close to the let-off point is corresponding to a target position, and the target amount of mean current u or duty ratio ui of driving signal is corresponding to "a magnitude".

The pedal stroke table in the read only memory 103, information processing system 10*a* and a part of subroutine program equivalent to the software modules 151 to 155 or 151 to 158 serve as "a source of control variable" by way of example. The motion/servo controller 140*b*, 140Ab, 140Bb, 140Cb, 140Db or 140Ea or pedal controller 140Fb is corresponding to the "source of control variable". The pulse width modulator 142*b* or 142*a* is corresponding to "a signal regulator."

The non-effective region and half pedal region are corresponding to "a predetermined region" and "another predetermined region", and the duty ratio ui at the actual pedal position yx1, yx2, . . . and the duty ratio ui at actual pedal position XH to XE are corresponding to "a relatively large value" and "a relatively small value", respectively. The duty ratio ui at the target pedal velocity Yv is further corresponding to the "relatively large value".

The motion controller 150*a* or 150Da serves as "a source of target physical quantity", and the servo controller 150*b* or 150Db serves as "a control variable generator." The target pedal position rx, both of the target pedal position rx and target pedal velocity rv or target key position rv is corresponding to "a target physical quantity", and a variable of serves as "a variable."

The mechanical tone generating system 1*b* serves as "a mechanical tone generating system". The loudness of tones, quality of tones, sustaining time of tones or pitch of tones is "an attribute".

What is claimed is:

1. An electronic supporting system for a human player who plays on a musical instrument equipped with at least one manipulator moved by said human player from a rest position to an end position through a track, comprising:

an actuator provided for said at least one manipulator, and responsive to a driving signal for exerting an assisting force on said at least one manipulator, thereby making load for moving said at least one manipulator on said track sharable between said human player and said actuator;

a sensor monitoring said at least one manipulator, and producing a detecting signal representative of an actual physical quantity expressing movements of said at least one manipulator on said track; and a controller connected to said sensor and said actuator, checking said actual physical quantity to see whether said at least one manipulator reaches a target position on said track for producing an answer, and varying a magnitude of said driving signal depending upon said answer for removing said assisting force from said at least one manipulator at said target position.

2. The electronic supporting system as set forth in claim 1, in which said controller has a source of control variable producing a control variable expressing said magnitude, and a signal regulator connected to said source of control variable and adjusting said driving signal to said magnitude expressed by said control variable.

3. The electronic supporting system as set forth in claim 2, in which said target position is found at a boundary between a predetermined region of said track and another predetermined region of said track, wherein said source of control variable regulates said control variable to a finite value while said at least one manipulator is traveling in said predetermined region and to zero while said at least one manipulator is traveling in said another predetermined region.

4. An electronic supporting system for a human player who plays on a musical instrument equipped with at least one manipulator moved by said human player from a rest position through a predetermined region and another predetermined region to an end position through a track, comprising:

an actuator provided for said at least one manipulator, and responsive to a driving signal for exerting an assisting force on said at least one manipulator, thereby making load for moving said at least one manipulator on said track sharable between said human player and said actuator;

a sensor monitoring said at least one manipulator, and producing a detecting signal representative of an actual physical quantity expressing movements of said at least one manipulator on said track; and a controller connected to said sensor and said actuator, checking said actual physical quantity to see whether said at least one manipulator reaches a target position on said track for producing an answer, and varying a magnitude of said driving signal depending upon said answer for changing a part of said load borne by said human player, wherein said target portion is found at a boundary between said predetermined region of said track and said another predetermined region of said track, and wherein said controller keeps said assisting force zero while said at least one manipulator is traveling in said predetermined region and increases said assisting force to a finite value while said at least one manipulator is traveling in said another predetermined region.

5. The electronic supporting system as set forth in claim 2, in which said source of control variable has a source of target physical quantity outputting a target physical quantity variable together with said actual physical quantity and a variable, and a control variable generator connected to said source of target physical quantity and said sensor so as to determine a difference between said target physical quantity and said actual physical quantity, and determining said control variable on the basis of said difference and said variable.

6. The electronic supporting system as set forth in claim 5, in which said source of target physical quantity adjusts said target physical quantity to a value of said actual physical quantity regardless of the value of said actual physical quantity, and adjusts said variable to a finite value until said target position and to zero at said target position.

7. The electronic supporting system as set forth in claim 5, in which said source of target physical quantity adjusts said variable to zero regardless of said actual physical quantity, and adjusts said target physical quantity to a value different from the value of said actual physical quantity until said target position and to said value of said actual physical quantity at said target position.

8. A musical instrument for performing a music tune by a human player, comprising:

at least one manipulator moved by said human player from a rest position to an end position through a track for designating an attribute of tones;

a mechanical tone generating system connected to said at least one manipulator, and producing said tones having said attribute; and an electronic supporting system including an actuator provided for said at least one manipulator and responsive to a driving signal for exerting an assisting force on said at least one manipulator, thereby making load for moving said at least one manipulator on said track sharable between said human player and said actuator, a sensor monitoring said at least one manipulator and producing a detecting signal representative of an actual physical quantity expressing movements of said at least one manipulator on said track, and a controller connected to said sensor and said actuator, checking said actual physical quantity to see whether said at least one manipulator reaches a target position on said track for producing an answer and varying a magnitude of said driving signal depending upon said answer for removing said assisting force from said at least one manipulator at said target position.

9. The musical instrument as set forth in claim 8, further comprising an automatic playing system for driving said at least one manipulator without any force exerted by said human player.

10. The musical instrument as set forth in claim 9, in which said actuator, said sensor and said controller are shared between said electronic supporting system and said automatic playing system, and a part of a computer program and another part of said computer program are respectively assigned to said electronic supporting system and said automatic playing system.

11. The musical instrument as set forth in claim 8, in which said at least one manipulator and said mechanical tone generator are a damper pedal and a combination of action units, hammers, strings, dampers incorporated in a piano.

12. The musical instrument as set forth in claim 11, in which said target position is a certain pedal position at a boundary between a non-effective region where said tones are produced without any effect and a half pedal region where said tones are produced at a small value of loudness.

13. The musical instrument as set forth in claim 8, in which said at least one manipulator and said mechanical tone generator are keys forming parts of a keyboard and a combination of action units, hammers, dampers and strings incorporated in a piano.

14. The musical instrument as set forth in claim 13, in which said target position is certain key positions close to left-off points where said hammers start free rotation toward said strings.

15. The musical instrument as set forth in claim 8, in which said controller has a source of control variable producing a control variable expressing said magnitude, and a signal regulator connected to said source of control variable and adjusting said driving signal to said magnitude expressed by said control variable.

16. The musical instrument as set forth in claim 15, in which said target position is found at a boundary between a predetermined region of said track and another predetermined region of said track, wherein said source of control variable regulates said control variable to a finite value while said at least one manipulator is traveling in said predetermined region and to zero while said at least one manipulator is traveling in said another predetermined region.

17. A musical instrument for performing a music tune by a human player, comprising:

at least one manipulator moved by said human player from a rest position through a predetermined region and another predetermined region to an end position through a track for designating an attribute of tones;

a mechanical tone generating system connected to said at least one manipulator, and producing said tones having said attribute; and an electronic supporting system including an actuator provided for said at least one manipulator and responsive to a driving signal for exerting an assisting force on said at least one manipulator, thereby making load for moving said at least one manipulator on said track sharable between said human player and said actuator, a sensor monitoring said at least one manipulator and producing a detecting signal representative of an actual physical quantity expressing movements of said at least one manipulator on said track, and a controller connected to said sensor and said actuator, checking said actual physical quantity to see whether said at least one manipulator reaches a target position on said track for producing an answer and varying a magnitude of said driving signal depending upon said answer, wherein said target portion is found at a boundary between said predetermined region of said track and said another predetermined region of said track, and wherein said controller keeps said assisting force zero while said at least one manipulator is traveling in said predetermined region and increases said assisting force to a finite value while said at least one manipulator is traveling in said another predetermined region.

18. The musical instrument as set forth in claim 15, in which said source of control variable has a source of target physical quantity outputting a target physical quantity variable together with said actual physical quantity and a variable, and a control variable generator connected to said source of target physical quantity and said sensor so as to determine a difference between said target physical quantity and said actual physical quantity, and determining said control variable on the basis of said difference and said variable.

19. The musical instrument as set forth in claim 18, in which said source of target physical quantity adjusts said target physical quantity to a value of said actual physical quantity regardless of the value of said actual physical quantity, and adjusts said variable to a finite value until said target position and to zero at said target position.

20. The musical instrument as set forth in claim 18, in which said source of target physical quantity adjusts said variable to zero regardless of said actual physical quantity, and adjusts said target physical quantity to a value different from the value of said actual physical quantity until said target position and to said value of said actual physical quantity at said target position.

* * * * *